US009725207B2

(12) United States Patent
Lu

(10) Patent No.: US 9,725,207 B2
(45) Date of Patent: Aug. 8, 2017

(54) EASY OPEN CARTON

(71) Applicant: MAGIC PACKING ENTERPRISE CO., LTD., Kaohsiung (TW)

(72) Inventor: Ya-Chen Lu, Kaohsiung (TW)

(73) Assignee: Magic Packing Enterprise Co., Ltd., Kaohsiung (TW)

( * ) Notice: Subject to any disclaimer, the term of this patent is extended or adjusted under 35 U.S.C. 154(b) by 28 days.

(21) Appl. No.: 14/697,730

(22) Filed: Apr. 28, 2015

(65) Prior Publication Data

US 2016/0318655 A1 Nov. 3, 2016

(51) Int. Cl.
*B65D 5/54* (2006.01)

(52) U.S. Cl.
CPC ..... *B65D 5/5445* (2013.01); *B65D 5/542* (2013.01)

(58) Field of Classification Search
CPC ..... B65D 5/5445; B65D 5/542
USPC ..... 229/235, 237, 238, 240, 242, 243
See application file for complete search history.

(56) References Cited

U.S. PATENT DOCUMENTS 3,004,697 A 10/1961 Stone
3,136,474 A * 6/1964 Schaus ..... B65D 5/5445 206/557
3,469,766 A * 9/1969 Nelson ..... B65D 5/5445 229/164
3,502,257 A * 3/1970 Virros ..... B65D 5/5445 229/207
5,507,432 A * 4/1996 Cyr ..... B65D 5/54 229/235
6,073,833 A * 6/2000 Desrosiers ..... B65D 5/5445 229/164
6,976,588 B2 * 12/2005 Wischusen ..... B65D 5/54 206/427
7,389,909 B2 * 6/2008 Crosland ..... B65D 5/10 229/117.15
8,596,460 B2 * 12/2013 Scatterday ..... B65D 5/54 206/736
9,260,215 B2 * 2/2016 Coltri-Johnson ..... B65D 5/445
2002/0043554 A1 * 4/2002 White ..... A47F 5/112 229/235

FOREIGN PATENT DOCUMENTS

CN 102259440 A 11/2011
TW 194682 11/1992

* cited by examiner

*Primary Examiner* — Christopher Demeree
*Assistant Examiner* — Phillip Schmidt
(74) *Attorney, Agent, or Firm* — Alan D. Kamrath; Kamrath IP Lawfirm, P.A.

(57) ABSTRACT

An easy open carton includes a paperboard having an inner face and an outer face. The paperboard includes a plurality of folding flaps permitting the paperboard to be folded to form a three dimensional carton. At least one cut line is provided on the inner face of the paperboard. The paperboard further includes a force application portion having a plurality of cuts disposed intermittently or continuously. Each cut extends from the inner face through the outer face of the paperboard. The force application portion is connected to the at least one cut line.

14 Claims, 23 Drawing Sheets

EASY OPEN CARTON

BACKGROUND OF THE INVENTION

1. Field of the Invention

The present invention relates to a carton and, more particularly, to an easy open carton that can easily be torn to form an opening for exposing an interior thereof.

2. Description of the Related Art

FIG. 1 shows a conventional easy open carton 8 including two tear lines 81. Each tear line 81 includes a succession of spaced cut lines 811 each extending from an inner face through an outer face of the carton body of the easy open carton 8. A tear portion 82 is formed between the tear lines 81 and can be pulled by a user along the tear lines 81. Thus, the tear portion 82 can be torn from the easy open carton 8 to form an opening 83, permitting access to objects received in the easy open carton 8. An example of such an easy open carton 8 is disclosed in U.S. Pat. No. 3,004,697.

However, the cut lines 811 of the tear lines 81 of the easy open carton 8 extending through the outer face of the carton body result in poor structural strength at the portions of the carton body including the tear lines 81, such that unexpected damage by a force occurs easily. As an example, a portion of the tear lines 81 could break when the easy open carton 8 is pulled or inadvertently impacted during transportation, not only adversely affecting the appearance integrity of the easy open carton 8 but losing protection of the objects in the easy open carton 8. As a result, the objects in the easy open carton 8 are apt to be contaminated or to fall out of the easy open carton 8, adversely affecting the quality of the objects and causing loss.

FIG. 2 shows another conventional easy open carton 9 including an adhesive tape 91 bonded to an inner face of a portion of the carton body to be torn away. A pull tab 92 is provided on an outer face of the carton body. A user can pull the pull tab 92 to form a tear portion 93 on the carton body, assuring the tear portion 93 to be separated from the carton body along the tearing path to which the adhesive tape 91 is bonded to the carton body. An example of such an easy open carton 9 is disclosed in Taiwan Patent Publication No. 194682 entitled "TAPE AUTOMATIC BONDING MACHINE FOR TEARING OPEN PAPERBOARDS (CORRUGATED BOARDS)".

Since the outer face of the easy open carton 9 does not have cut lines, the structural strength of the easy open carton 9 will not be adversely affected by the tear function, reducing the risk of unexpected damage by an external force.

However, in addition to the cost of paperboards, production of the easy open carton 9 also involves the adhesive tape 91, leading to an increase in the overall costs. Furthermore, securely and neatly bonding of the adhesive tape 91 to the inner face of the carton body during production of the easy open carton 9 requires a skilled worker or a special bonding machine. Of more importance, due to the difficulties in providing a curved bonding path for the adhesive tape 91, it is almost impossible to obtain a non-rectilinear tearing path on the easy open carton 9, failing to meet various needs in use. Thus, the easy open carton 9 cannot replace the above easy open carton 8 shown in FIG. 1. As a result, many of the easy open cartons still use a structure similar to that of the easy open carton 8.

Thus, improvement to conventional easy open cartons is needed.

SUMMARY OF THE INVENTION

An objective of the present invention is to provide an easy open carton preventing unexpected damage by an external force and including an arbitrarily disposed tear path without increasing the material costs, providing enhanced utility.

Another objective of the present invention is to provide an easy open carton providing convenient operation while disposing of the tear path.

An easy open carton according to the present invention includes a paperboard having an inner face and an outer face. The paperboard includes a plurality of folding flaps permitting the paperboard to be folded to form a three dimensional carton. At least one cut line is provided on the inner face of the paperboard. The paperboard further includes a force application portion having a plurality of cuts disposed intermittently or continuously. Each of the plurality of cuts extends from the inner face through the outer face of the paperboard. The force application portion is connected to the at least one cut line.

In an embodiment, the plurality of cuts outlines a pull tab.

In an embodiment, the at least one cut line includes a cut line, and the pull tab is connected between two ends of the cut line.

The cut line can extend along an annular top edge of the carton formed by the paperboard.

The pull tab can include an insertion slot extending from the inner face through the outer face of the paperboard and connected to the plurality of cuts on the pull tab.

In another embodiment, the at least one cut line includes two cut lines. The inner face of the paperboard can include a tear portion formed between the two cut lines, and the pull tab is connected to an end of the tear portion.

In a further embodiment, the easy open carton further includes a start index disposed on one of the plurality of folding flaps and connected to another end of the tear portion. When the paperboard is folded to form the three dimensional carton, the one of the plurality of folding flaps including the start index is connected to another of the plurality of folding flaps including the pull tab.

In an example, the start index is a notch extending from the inner face through the outer face of the paperboard.

In another example, the start index is an area outlined by a plurality of another cuts disposed intermittently or continuously, and each of the plurality of another cuts outlining the start index extends from the inner face through the outer face of the paperboard.

In still another embodiment, the pull tab includes a finger width portion and an extension connected between the finger width portion and the tear portion of the paperboard. The extension has increasing or decreasing widths to smoothly connect the finger width portion to the tear portion of the paperboard.

The pull tab can have an overall length of 3-6 cm.

In an example, the plurality of cuts on the pull tab adjacent to a bottom of the carton and one of the two cut lines adjacent to the bottom of the carton are on the same line.

In another embodiment, the paperboard further includes a plurality of another cuts outlining another pull tab, and the another pull tab is connected between two ends of one of the two cut lines adjacent to the bottom of the carton.

The pull tab can include a finger width portion having a width of 1-3 cm and a length of 1-3 cm.

In a further embodiment, the plurality of cuts and the at least one cut line together outline a shield piece.

In an embodiment, the paperboard is a corrugated paper including an inner paper layer and an outer paper layer directly or indirectly connected to the inner paper layer. The inner paper layer includes the inner face of the paperboard.

The outer paper layer includes the outer face of the paperboard. The inner paper layer is severed by the at least one cut line.

In another embodiment, the paperboard is a paperboard having a single layer. The depth of the at least one cut line is smaller than or equal to a half of a depth of the paperboard.

The present invention will become clearer in light of the following detailed description of illustrative embodiments of this invention described in connection with the drawings.

DETAILED DESCRIPTION OF THE INVENTION

Figure 1:
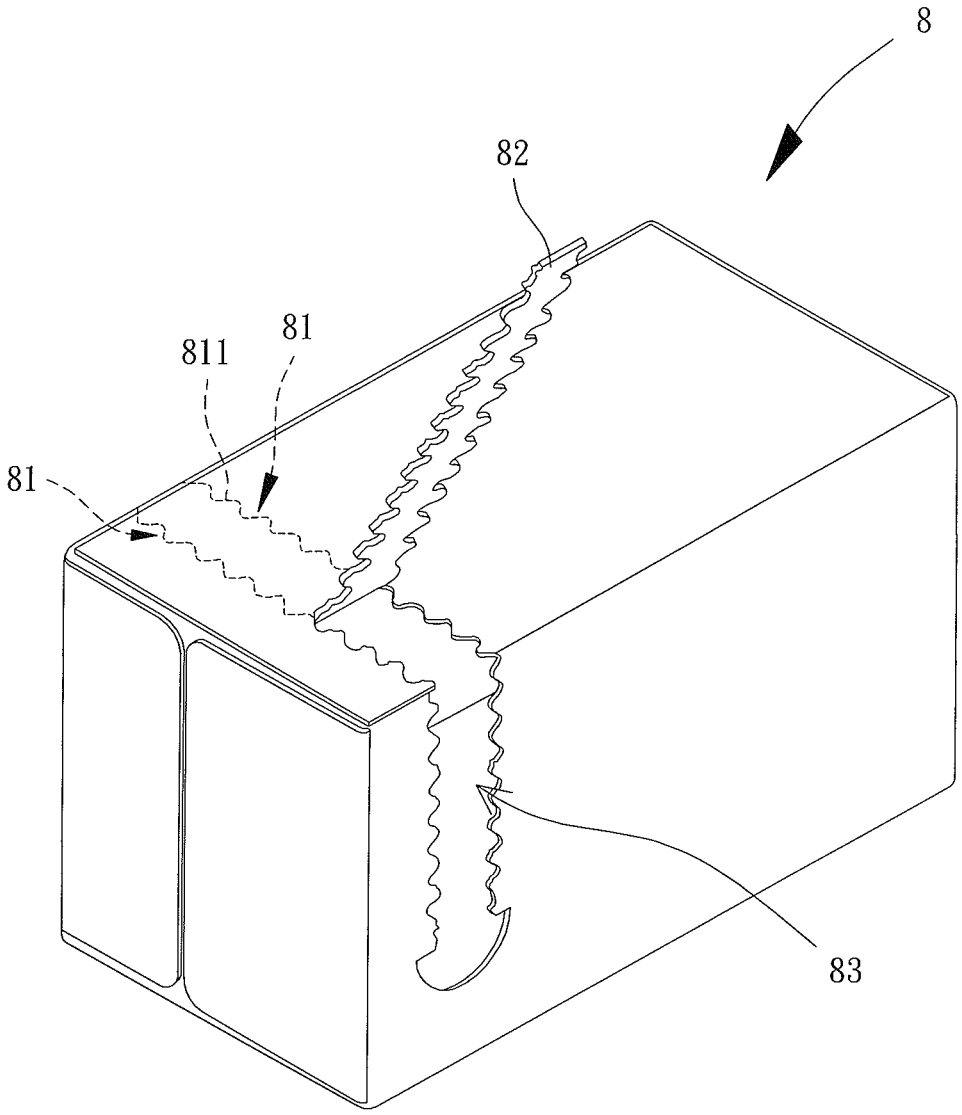
FIG. 1 PRIOR ART
FIG. 1 is a perspective view of a conventional easy open carton.
Figure 2:
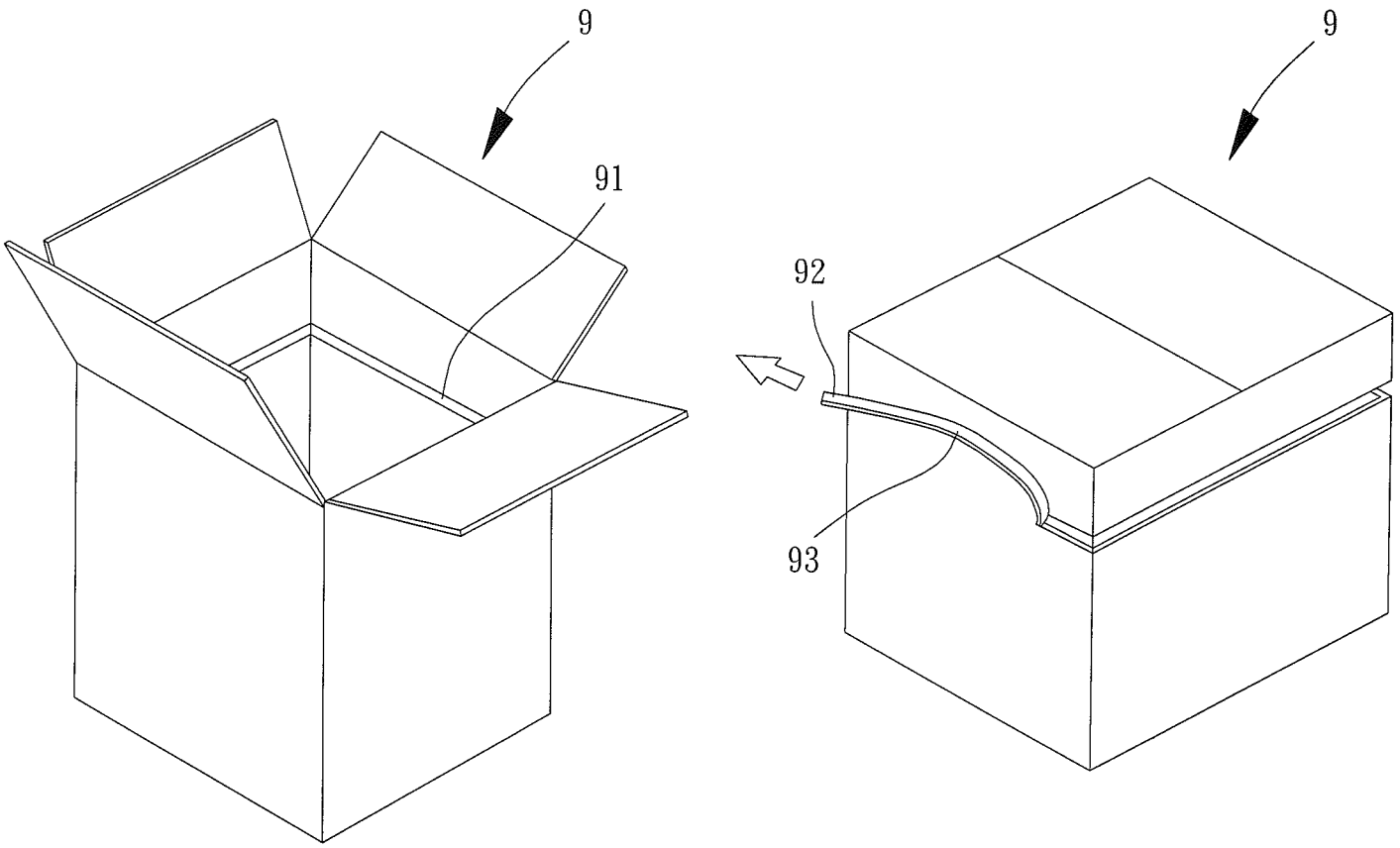
FIG. 2 PRIOR ART
FIG. 2 is a perspective view of another conventional easy open carton.
Figure 3:
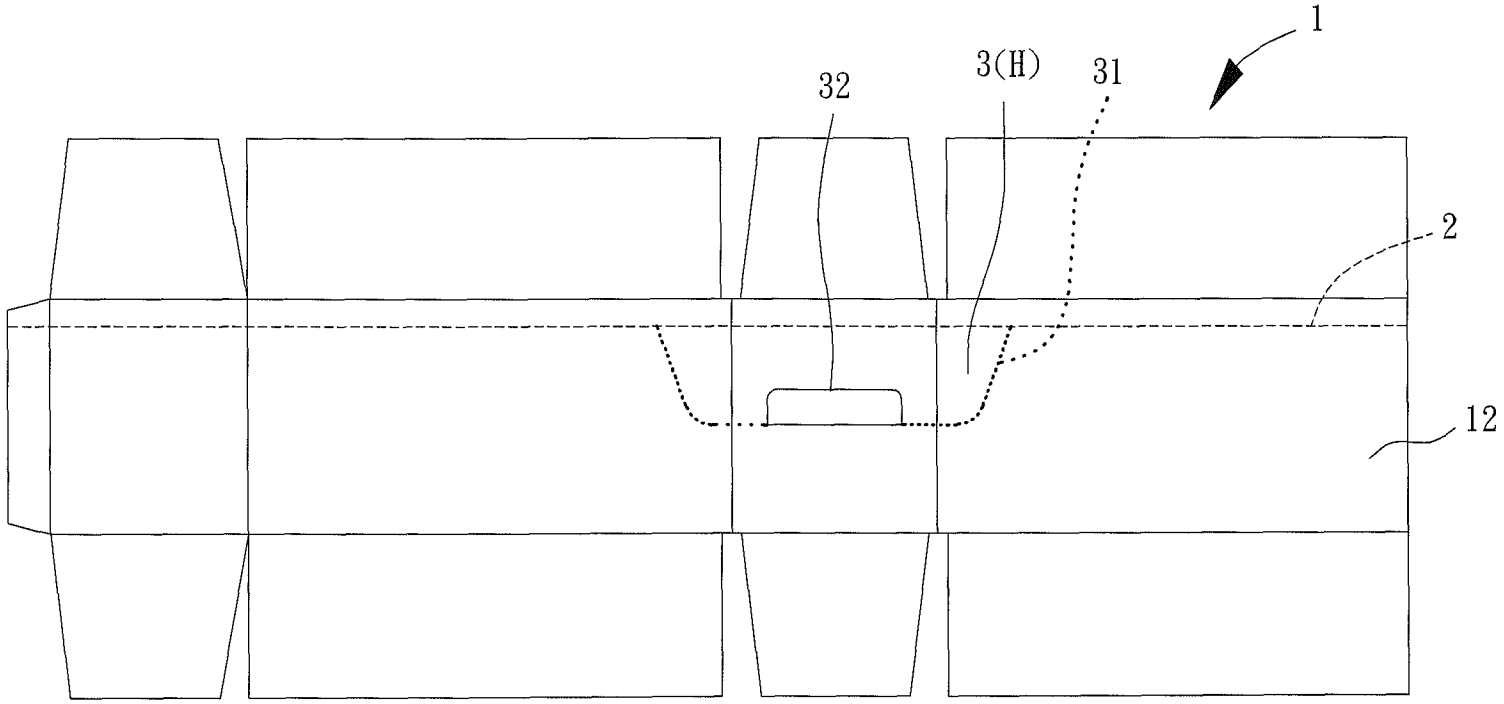
FIG. 3 is a flattened view of an easy open carton of a first embodiment according to the present invention.
Figure 7:
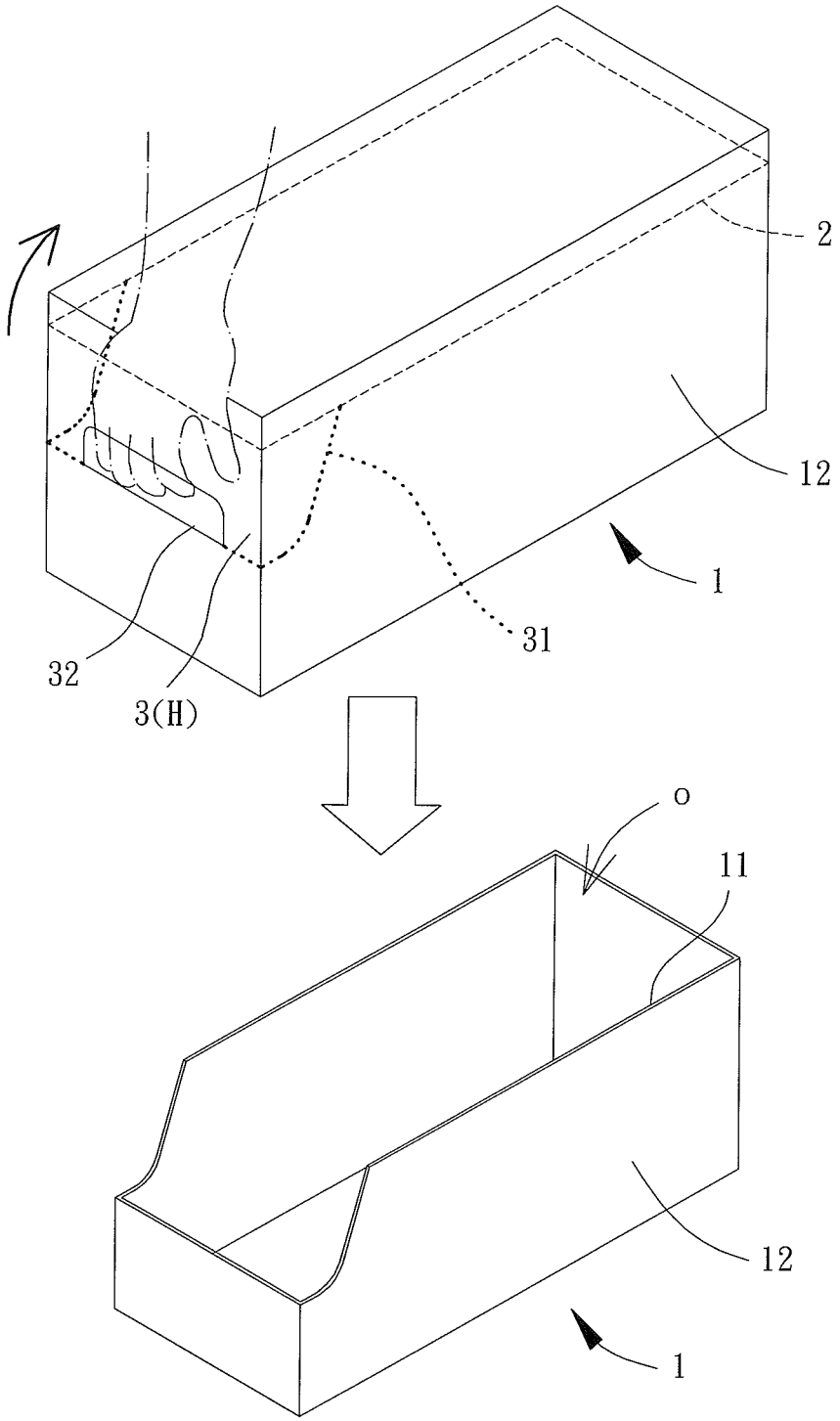
FIG. 7 is a perspective view illustrating tearing open of the easy open carton of the first embodiment according to the present invention.

With reference to FIGS. 3 and 7, an easy open carton of a first embodiment according to the present invention generally includes a paperboard 1, at least one cut line 2, and a force application portion 3 connected to the at least one cut line 2. The paperboard 1 is configured to be folded into a three dimensional shape to form a carton. Both of the at least one cut line 2 and the force application portion 3 are provided on the paperboard 1. When a user applies a force on the force application portion 3, an opening O can be formed in the carton constructed by the paperboard 1 by tearing along the at least one cut line 2, exposing an interior of the carton.

The paperboard 1 includes an inner face 11 and an outer face 12. The paperboard 1 includes a plurality of folding flaps permitting the paperboard 1 to be folded to form a three dimensional carton for receiving objects which can contact with the inner face 11 of the paperboard 1. The outline of the paperboard 1 can be varied according to needs. For example, the outline of the paperboard 1 can be used to construct a cubic carton, a parallelepiped carton, a pyramid carton, a house-shaped carton, or a carton of any other shape. Furthermore, the size of the paperboard 1 is not limited in the present invention. The paperboard 1 can be used to construct a small carton for receiving a single candy or a large carton for receiving a household electric appliance.

Figure 4:
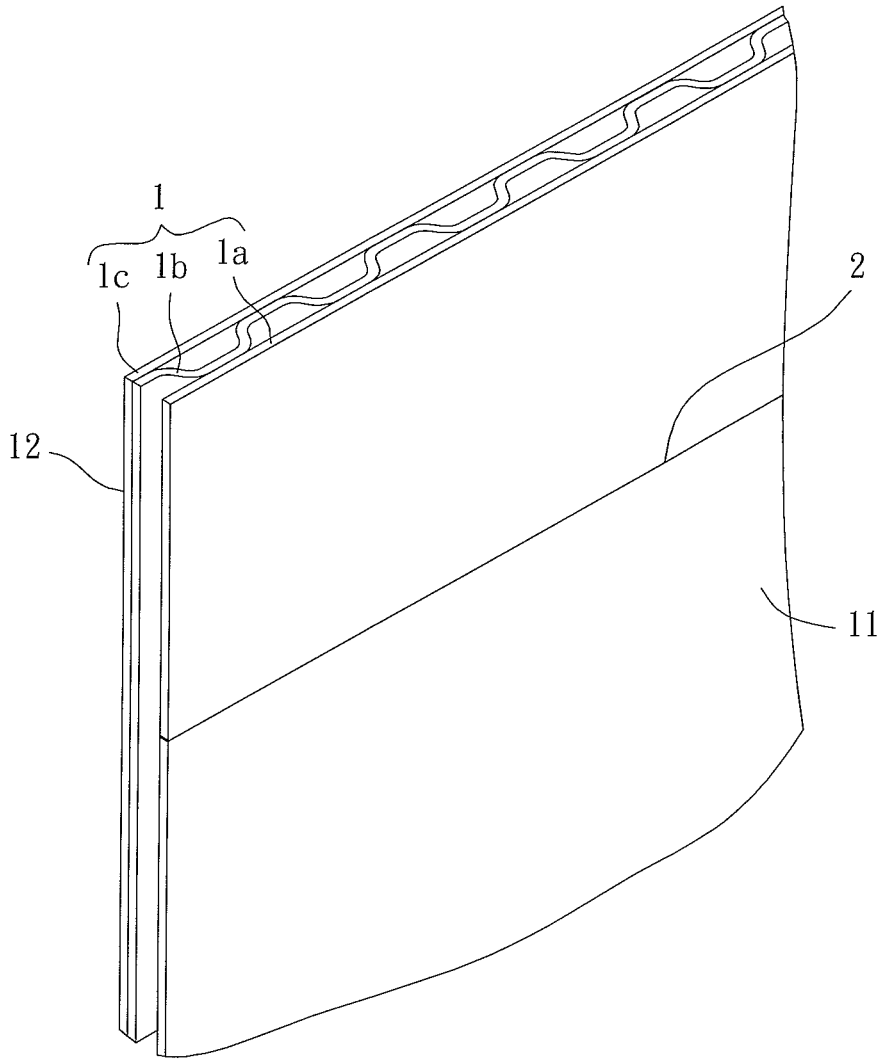
FIG. 4 is a partial, perspective view illustrating formation of a cut line on a three-layer corrugated paper according to the present invention.

With reference to FIGS. 3 and 4, the at least one cut line 2 is provided on the inner face 11 of the paperboard 1 and does not extend to the outer face 12 of the paperboard 1, such that the carton formed by the paperboard 1 can maintain good structural strength while providing an easy-to-tear function.

In this embodiment, the paperboard 1 is a three-layer corrugated paper including an inner paper layer 1*a*, a middle paper layer 1*b*, and an outer paper layer 1*c*. The middle paper layer 1*b* is connected between the inner paper layer 1*a* and the outer paper layer 1*c*. The inner paper layer 1*a* includes the inner face 11 of the paperboard 1. The outer paper layer 1*c* includes the outer face 12 of the paperboard 1. In processing, a cutter is used to directly cut a cut line 2 on the inner face 11 of the paperboard 1 to sever the inner paper layer 1*a* without damaging the outer paper layer 1*c* and preferably not damaging the middle paper layer 1*b* of the three-layer corrugated paper, such that the carton has better structural strength.

Figure 6:
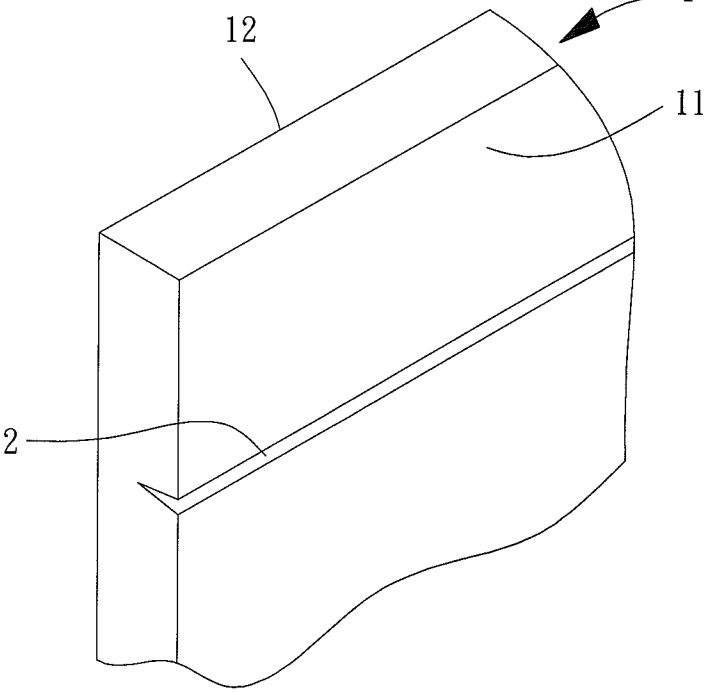
FIG. 6 is a partial, perspective view illustrating a paperboard with a cut line according to the present invention.
Figure 5:
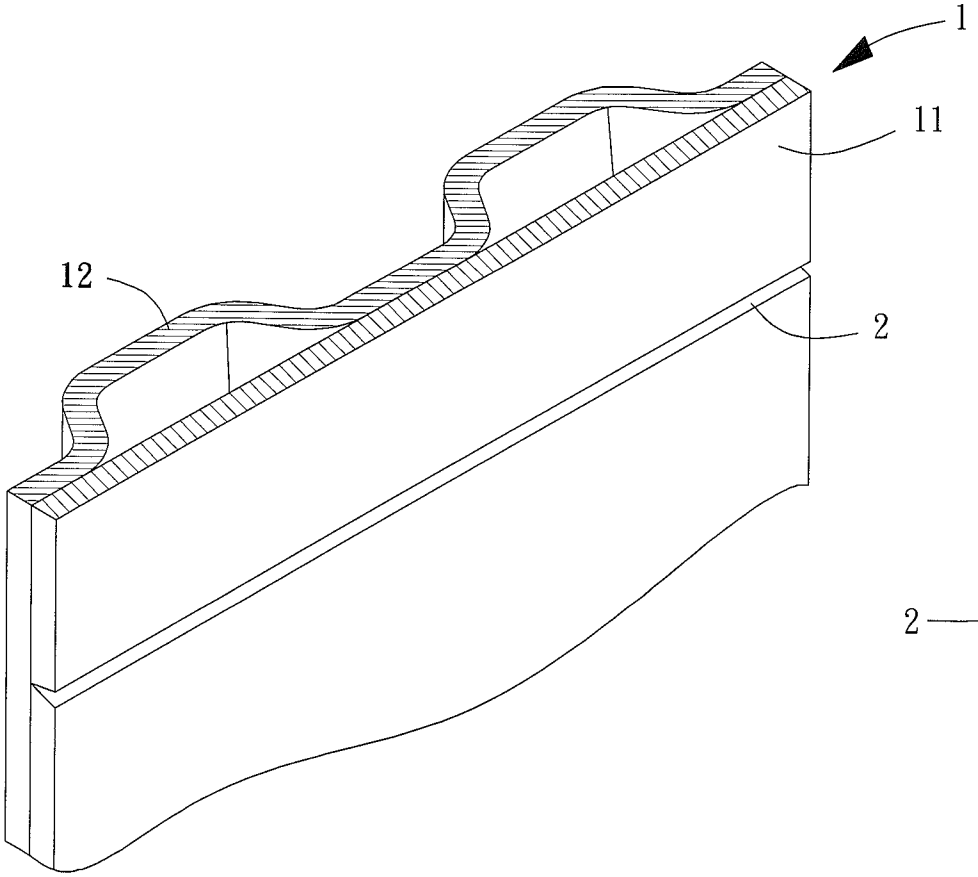
FIG. 5 is a partly-cutaway perspective view of a dual-layer corrugated paper with a cut line according to the present invention.

In another example shown in FIG. 5, the paperboard 1 is a dual-layer corrugated paper, and the cut line 2 preferably severs the inner paper layer without damaging the outer paper layer. In a further example shown in FIG. 6, the paperboard 1 is a paperboard having a single layer, and the cutter is used to cut the inner face 11 to form the cut line 2 with a predetermined depth. Preferably, the cutting depth of the cutter is smaller than or equal to half of the thickness of the paperboard 1.

With reference to FIGS. 3 and 7, the force application portion 3 includes a plurality of cuts 31 disposed intermittently or continuously. Each cut 31 extends from the inner face 11 through the outer face 12 of the paperboard 1. The force application portion 3 is connected to the at least one cut line 2. In this embodiment, the cuts 31 outlines a pull tab H connected between two ends of the cut line 2.

The pull tab H can include an insertion slot 32 extending from the inner face 11 through the outer face 12 of the paperboard 1, such that a portion of the pull tab H is hollow to permit the user to reach his or her fingers into the carton, assisting in convenience during transportation of the carton. In this embodiment, the cuts 31 of the pull tab H extend to different folding flaps of the paperboard 1. Thus, when the user intends to tear open the carton, the user reaches into the insertion slot 32 of the pull tab H from the outer face 12 of the paperboard 1 and pulls the pull tab H outwards to break the connection between each two adjacent cuts 31, separating the pull tab H from the remaining portion of the paperboard 1. The cuts 31 break one by one, and the cut line 2 begins to break after the connection between the cut line 2 and the cut 31 connected to the cut line 2 has broken. Thus, an opening O is torn open in the carton formed by the paperboard 1 along the cut line 2 to expose the interior of the carton, permitting access to the objects in the carton. The insertion slot 32 can be connected to the cuts 31 on the pull tab H, such that the pull tab H can be separated from the remaining portion of the paperboard 1 more easily, providing a force saving effect.

In a case that the cuts 31 on the pull tab H are disposed on the same folding flap, the user can directly press the pull tab H from the outer face 12 of the paperboard 1 to destruct the connection between each two adjacent cuts 31. The pull tab H is separated from the remaining portion of the paperboard 1 and is moved into the interior of the carton to complete destruction of the cut line 2, tearing open an opening O in the carton.

Figure 8:
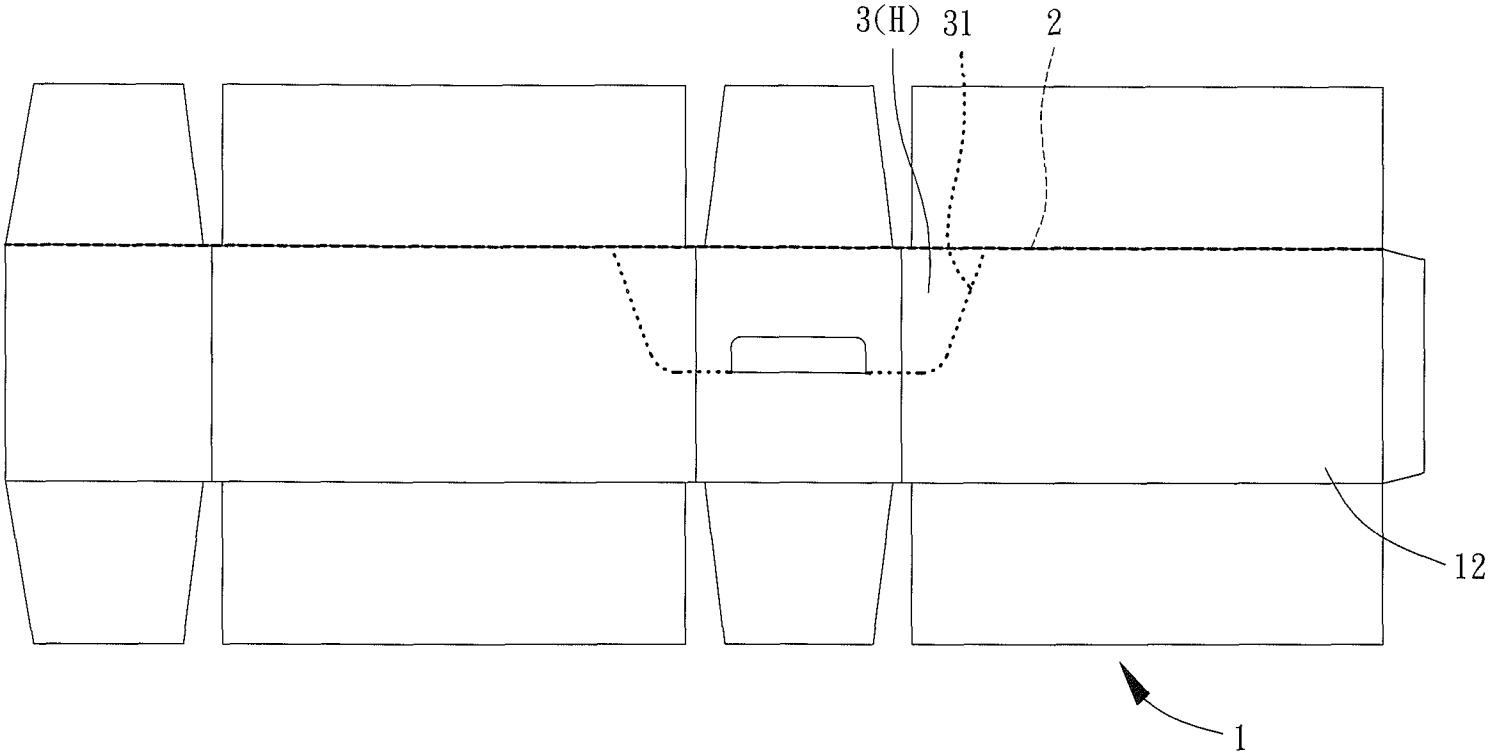
FIG. 8 is a flattened view of an easy open carton of another example with a single cut line according to the present invention.
Figure 9:
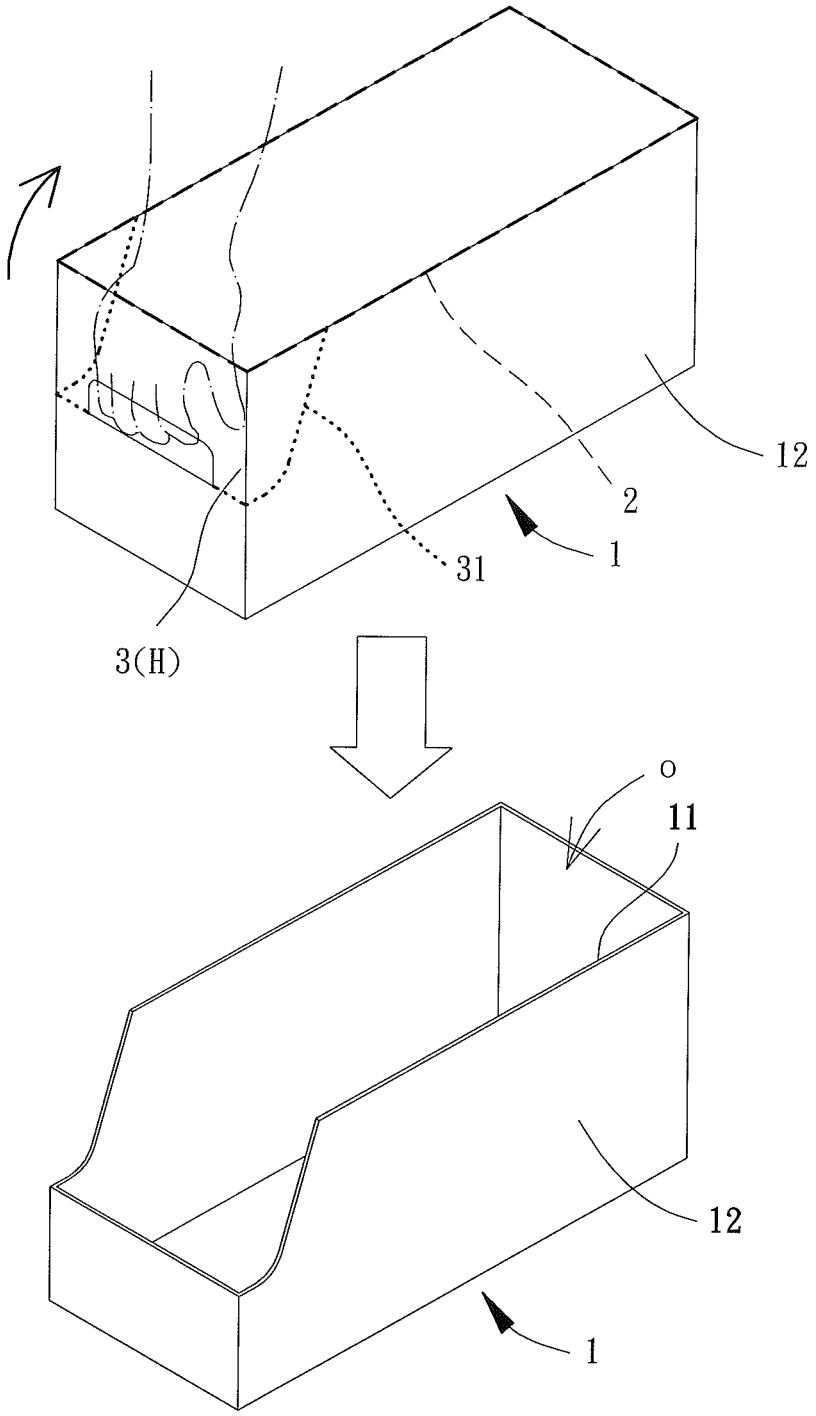
FIG. 9 is a perspective view illustrating tearing open of the easy open carton of FIG. 8.

Furthermore, the cut line 2 can pass through the inner sides of the folding flaps of the paperboard 1 and can form a continuous tearing path, as shown in FIG. 3. In another example shown in FIG. 8, the cut line 2 extends along an annular top edge of the carton formed by the paperboard 1, such that the peripheral face of the carton has better structural strength. Furthermore, after the opening O is torn open, the undamaged portion (see FIG. 9) of the paperboard 1 is large enough to avoid excessive reduction of the interior space of the carton, such that the objects received in the carton are less likely to fall out of the carton while tearing open the carton.

Figure 10:
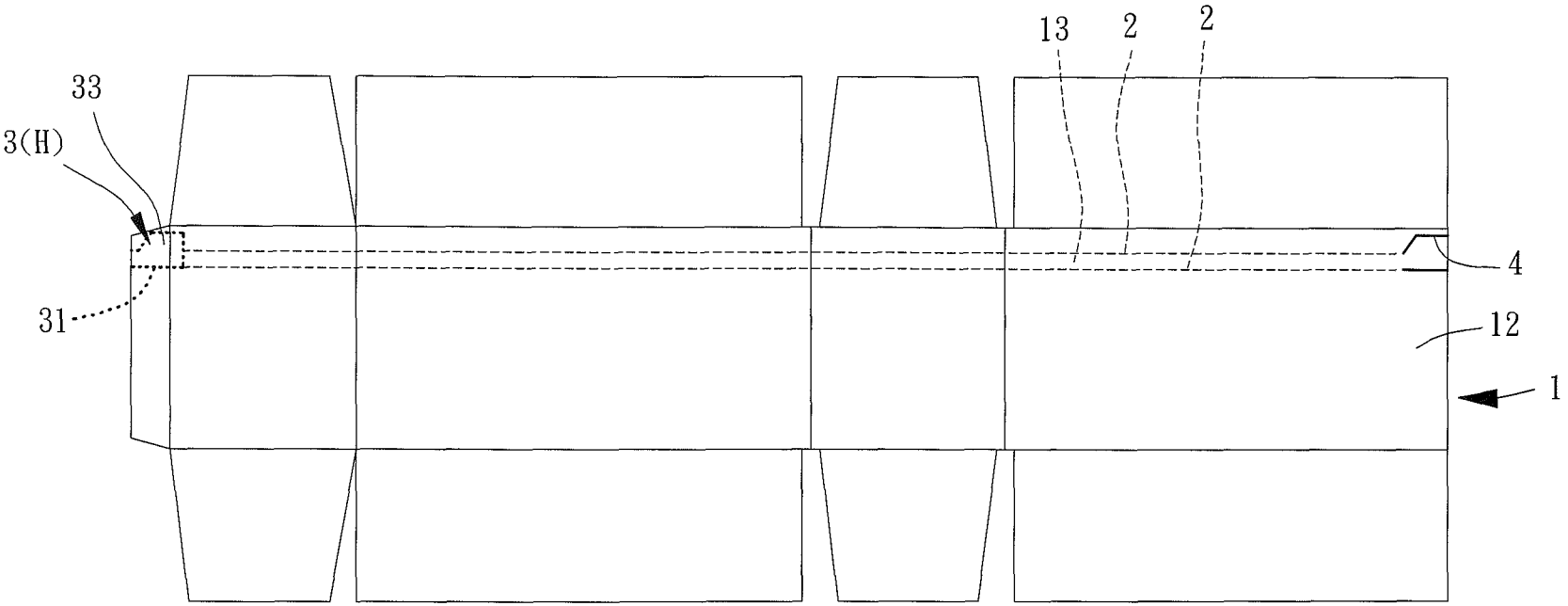
FIG. 10 is a flattened view of an easy open carton of a second embodiment according to the present invention.

FIG. 10 shows an easy open carton of a second embodiment according to the present invention. In this embodiment, the carton includes two cut lines 2. The pull tab H is connected to an end of each cut line 2.

Figure 11:
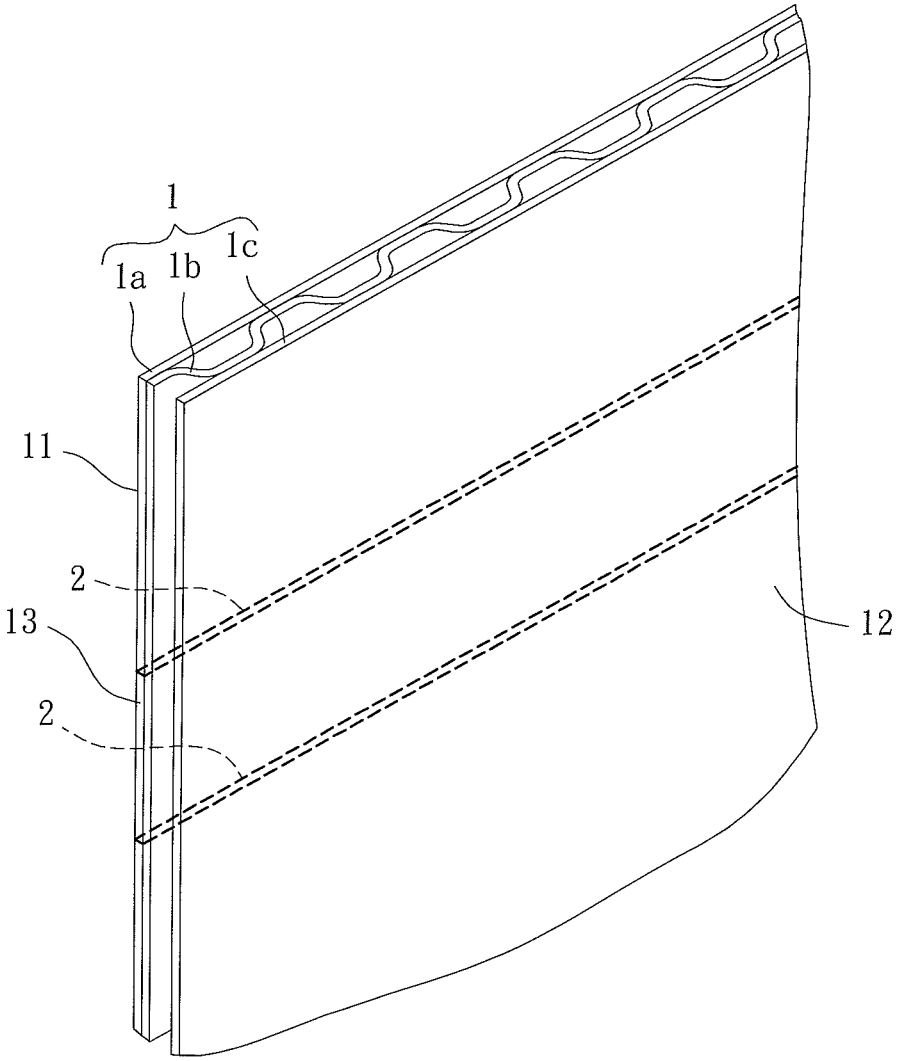
FIG. 11 is a partial, perspective view of the easy open carton of another example according to the present invention, illustrating two cut lines on the inner face of a paperboard of the easy open carton.
Figure 12:
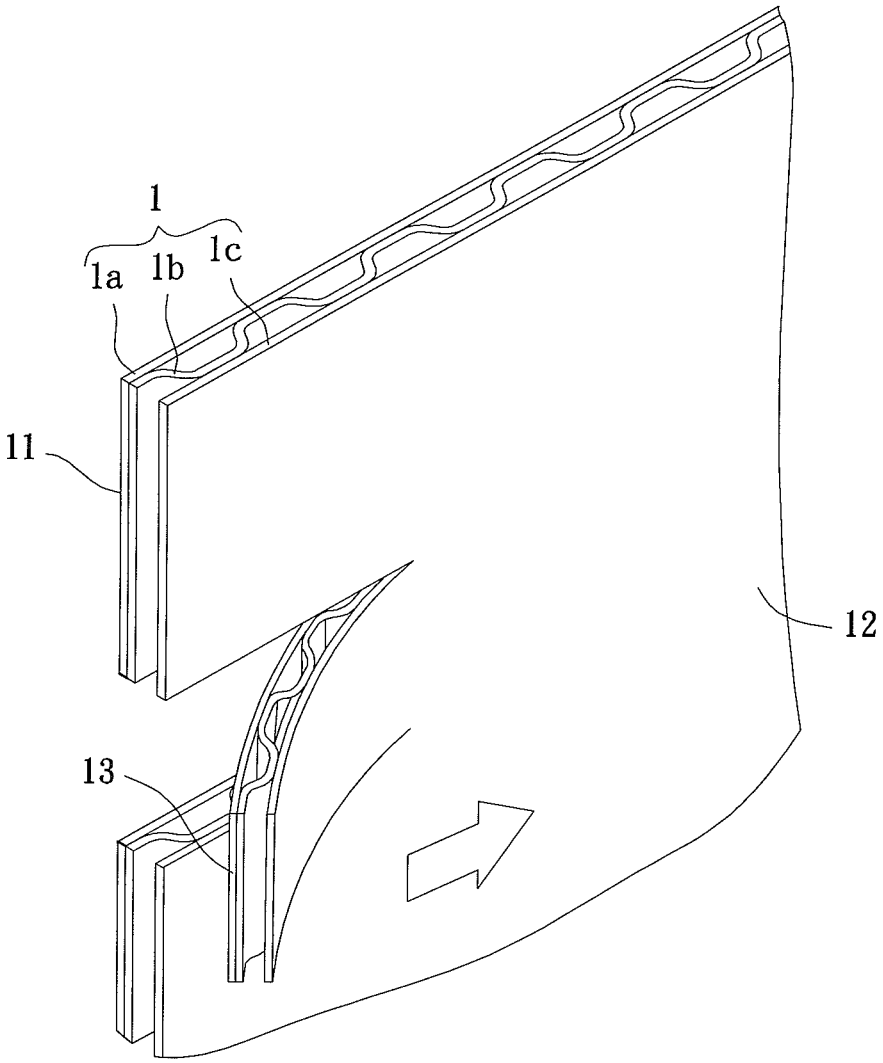
FIG. 12 is a view similar to FIG. 11, illustrating separation of the tear portion from the remaining portion of the paperboard.

Specifically, with reference to FIGS. 11 and 12, the inner face 11 of the paperboard 1 includes a tear portion 13 formed between the two cut lines 2. At the inner face 11 of the paperboard 1, the tear portion 13 breaks along the two cut lines 2 when the user pulls the tear portion 13 by the outer face 12 of the paperboard 1, such that the inner side of the tear portion 13 separates from the remaining portion of the paperboard 1 first, forming a structure similar to a remaining portion of a piece of paper after tearing a portion of the piece of paper by placing a ruler upon the piece of paper. The pulling force towards the outer face 12 of the paperboard 1 causes the tear portion 13 of the paperboard 1 to break from the inner face 11 towards the outer face 12. Thus, the outer face 12 of the paperboard 1 also separates from the remaining portion of the paperboard 1 along the two cut lines 2, such that the tear portion 13 can neatly be torn along the two cut lines 2.

Figure 13:
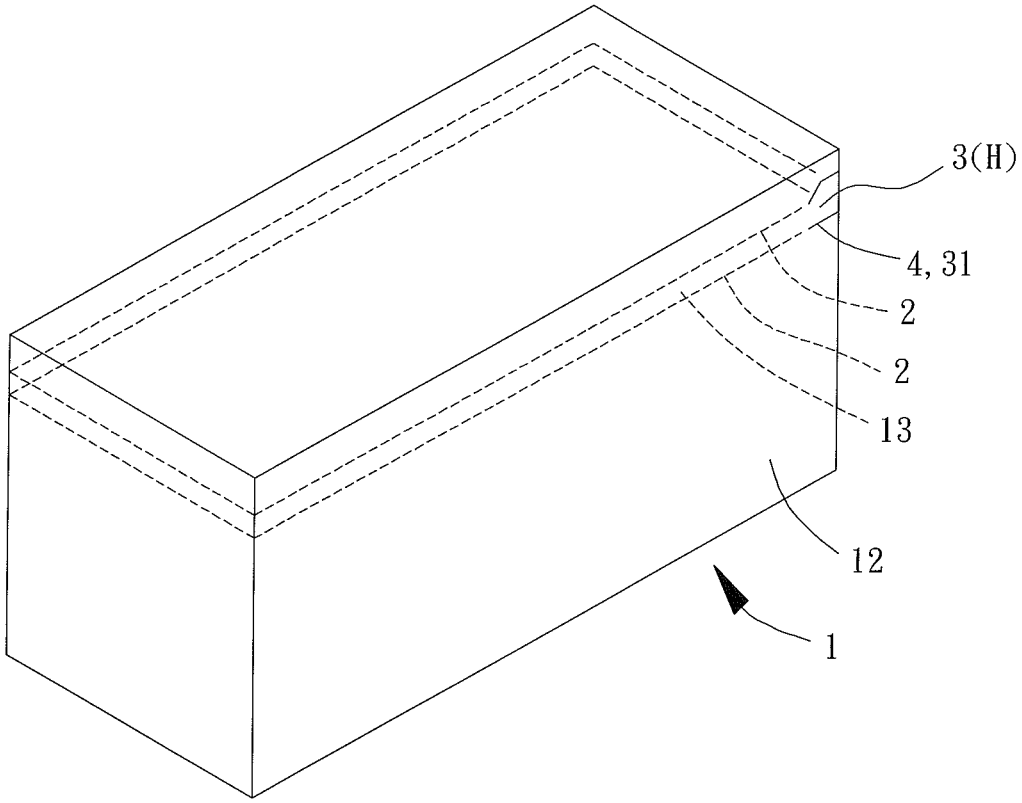
FIG. 13 is a perspective view of the easy open carton of the second embodiment according to the present invention.

With reference to FIGS. 10 and 13, the pull tab H is connected to an end of each cut line 2 (i.e., connected to an end of the tear portion 13). In a case that the width of the tear portion 13 is smaller than the width of the fingers of the user, the pull tab H can include a finger width portion 33 having a width substantially approximating the width (about 1-3 cm) of the fingers. The length of the finger width portion 33 is about 1-3 cm to provide enhanced operational convenience while applying a force to the pull tab H.

When the paperboard 1 is folded to form the three dimensional carton, the pull tab H is concealed due to mutual connections between the folding flaps. The easy open carton can further include a start index 4 disposed on one of the folding flaps and connected to the other end of the tear portion 13. When the paperboard 1 is folded to form the carton, the one of the folding flaps including the start index 4 is connected to another folding flap including the pull tab H, such that the start index 4 can indicate to the user where to start tearing open the carton. In this embodiment, the start index 4 can be an area outlined by a plurality of cuts disposed intermittently or continuously, and each of the cuts outlining the start index 4 extends from the inner face 11 through the outer face 12 of the paperboard 1.

Figure 14:
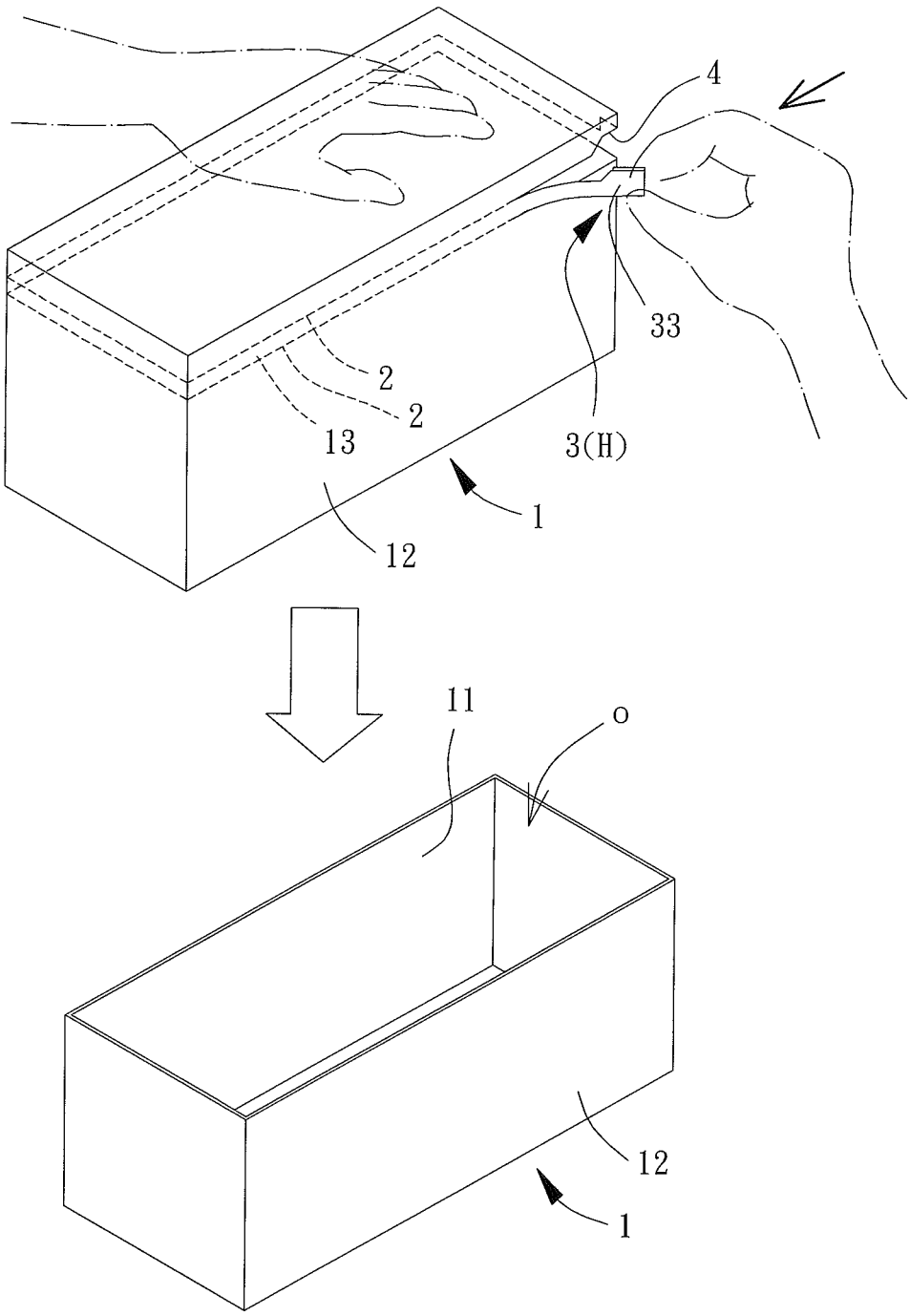
FIG. 14 is a perspective view illustrating tearing open of the easy open carton of the second embodiment according to the present invention.

With reference to FIGS. 13 and 14, when the paperboard 1 is folded to form the three dimensional carton, the user can see the cuts on the start index 4 from the appearance of the carton. The user can poke in the carton by the start index 4 and can press through the start index 4 and the pull tab H to separate the pull tab H from the remaining portion of the paperboard 1. Then, the user grips the start index 4 and the pull tab H and applies a force to pull the tear portion 13, separating the tear portion 13 from the remaining portion of the paperboard 1 and tearing open an opening O in the carton to expose the interior of the carton. The direction of tearing of the tear portion 13 can be the counterclockwise direction shown in FIG. 14 or the clockwise direction, which can be appreciated by a person having ordinary skill in the art. The start index 4 of this embodiment does not affect the appearance integrity of the carton. The user has to press through the start index 4 before pressing through the pull tab H, such that the pull tab H is less likely to be damaged in an unexpected manner.

In another embodiment, the start index 4 is a notch extending from the inner face 11 through the outer face 12 of the paperboard 1. When the paperboard 1 is folded to form the three dimensional carton, the user can clearly see the start index 4 from the appearance of the carton and can rapidly separate the pull tab H from the remaining portion of the pull tab H by poking the start index 4. Then, the user grips the pull tab H and applies a force to pull the tear portion 13, separating the tear portion 13 from the remaining portion of the paperboard 1 and tearing open an opening O in the carton.

With reference to FIGS. 10 and 14, in this embodiment, the cuts 31 on the pull tab H adjacent to a bottom of the carton and one of the two cut lines 2 adjacent to the bottom of the carton are on the same line. After the tear portion 13 is torn off, the pull tab H will not leave any notch in a peripheral edge of the opening O of the carton, increasing the appearance aesthetics of the carton.

Figure 15:
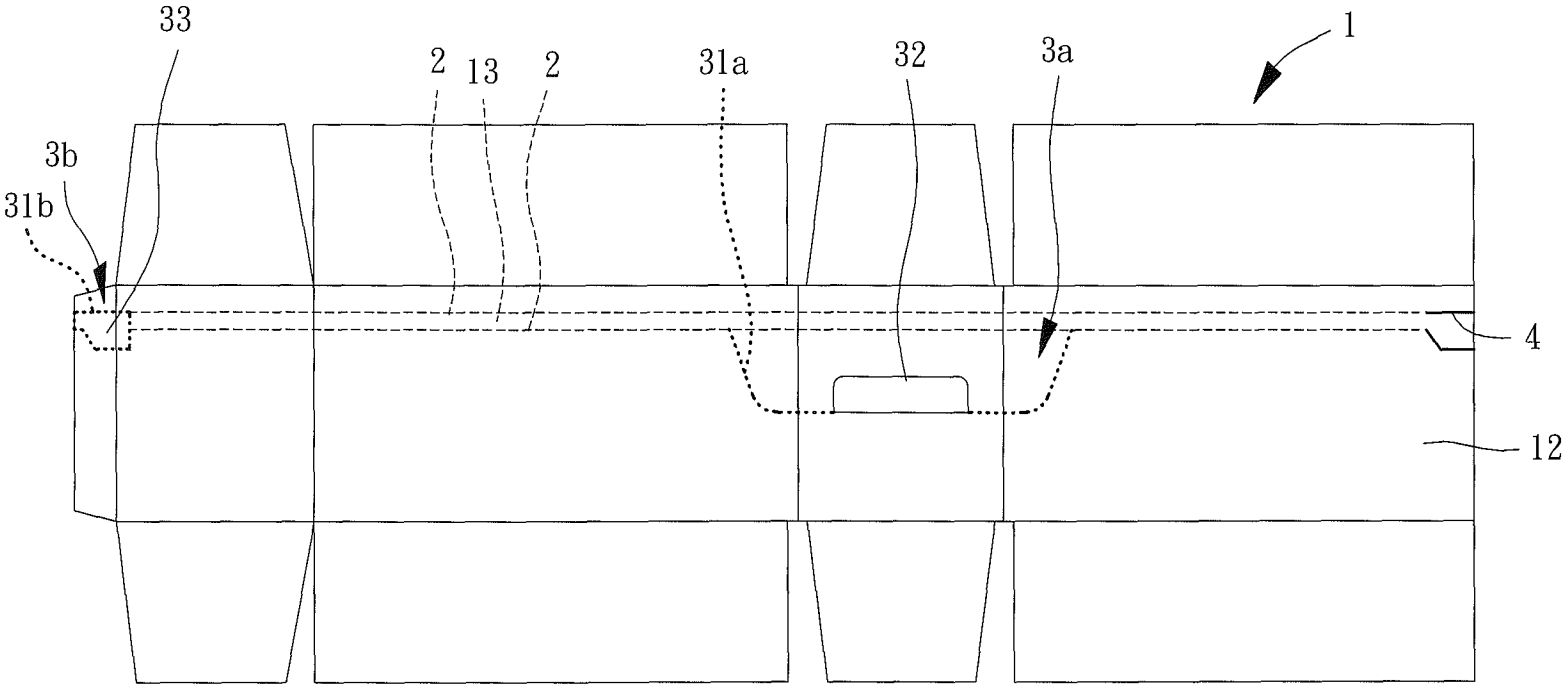
FIG. 15 is a flattened view of an easy open carton of a third embodiment according to the present invention.

FIG. 15 shows an easy open carton of a third embodiment according to the present invention. The third embodiment also includes pull tabs (designated by 3*a*, 3*b*) similar to the pull tab H of the first and second embodiments to provide two different tearing open options for the user.

Specifically, the easy open carton of this embodiment includes two pull tabs 3*a* and 3*b*. The pull tab 3*a* is outlined by the intermittently or continuously disposed cuts 31*a* and is connected between two ends of one of the two cut lines 2 adjacent to the bottom of the carton. The pull tab 3*b* is outlined by the intermittently or continuously disposed cuts 31*b* and is connected to an end of each cut line 2 (i.e., connected to an end of the tear portion 13).

Figure 16:
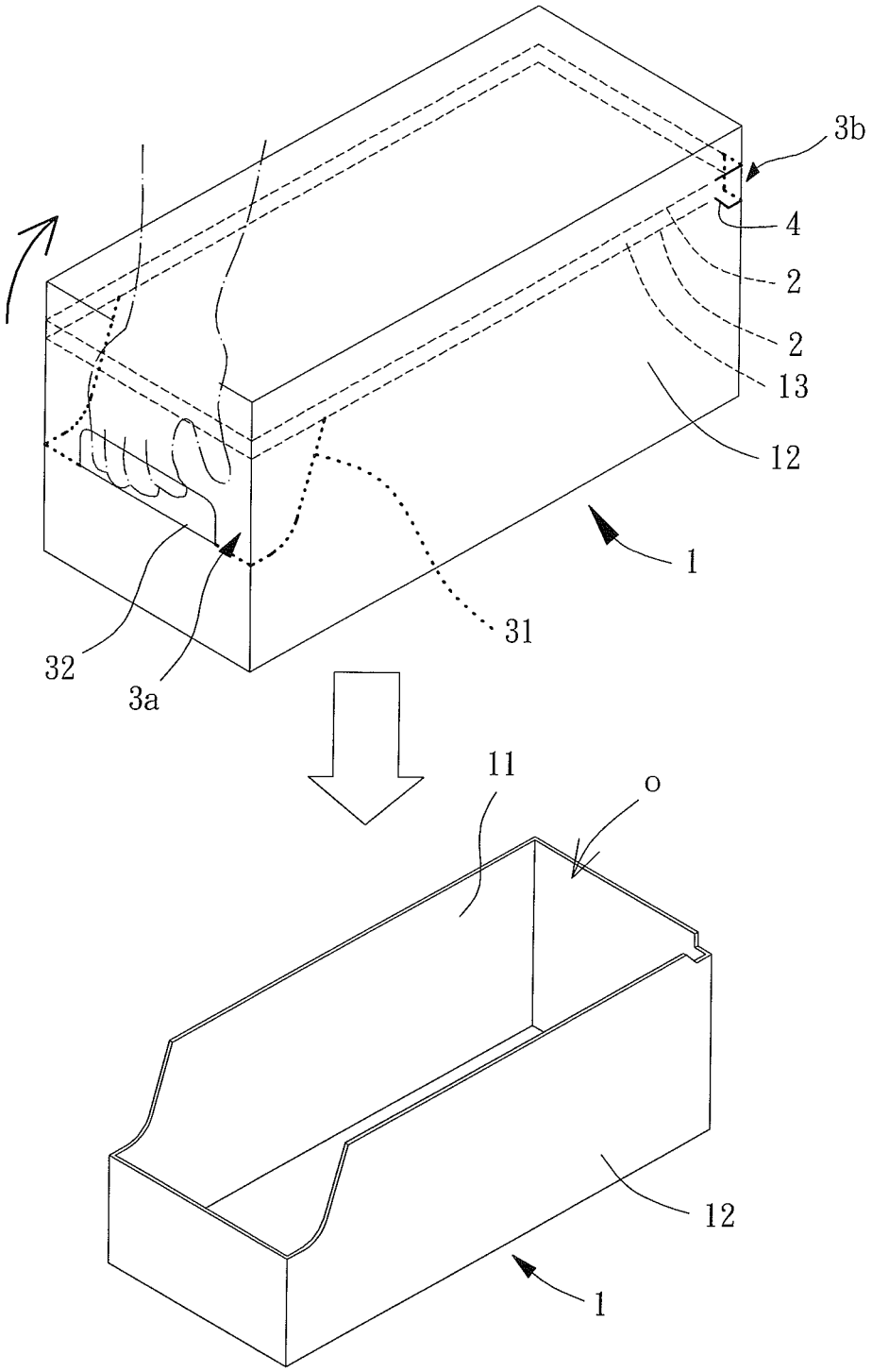
FIG. 16 is a perspective view illustrating an example of tearing open of the easy open carton of the third embodiment according to the present invention.

With reference to FIG. 16, when the user selects the pull tab 3*a* to tear open the carton, the user pulls the pull tab 3*a* out of the outer face 12 of the paperboard 1 or presses the pull tab 3*a* to destruct the connection between each two adjacent cuts 31*a*, separating the pull tab 3*a* from the remaining portion of the paperboard 1. The cuts 31*a* on the pull tab 3*a* break one by one, and the cut line 2 adjacent to the bottom of the carton begins to break after the connection between this cut line 2 and the cut 31*a* connected to this cut line 2 has broken. Thus, an opening O is torn open in the carton along the cut line 2 adjacent to the bottom of the carton, exposing the interior of the carton.

Figure 17:
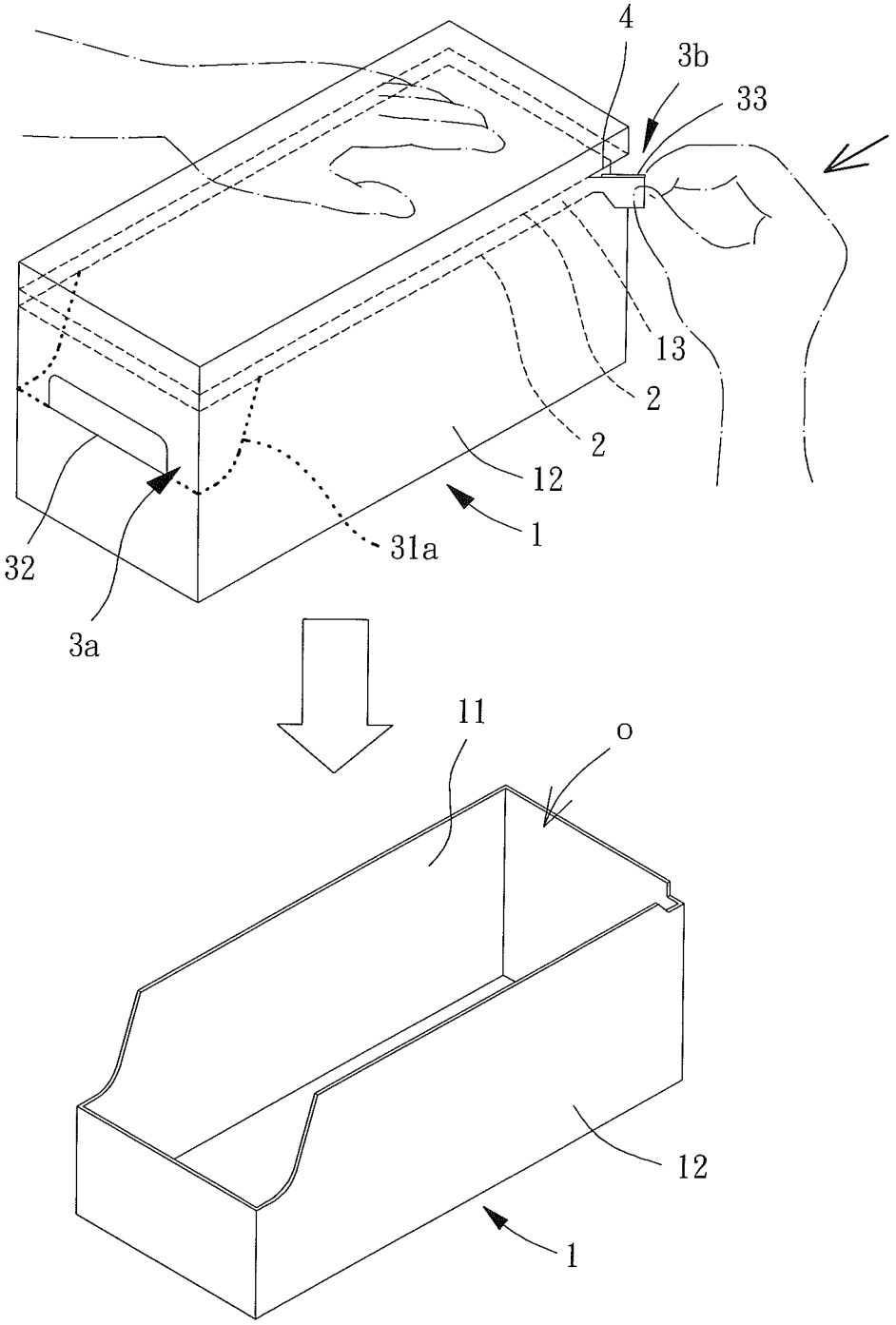
FIG. 17 is a perspective view illustrating another example of tearing open of the easy open carton of the third embodiment according to the present invention.

Alternatively, with reference to FIG. 17, when the user selects the pull tab 3*b* to tear open the carton, the user pulls the pull tab 3*b* out of the outer face 12 of the paperboard 1 or presses the pull tab 3*b* to destruct the connection between each two adjacent cuts 31*b*, separating the pull tab 3*b* from the remaining portion of the paperboard 1. Then, the tear portion 13 connected to the pull tab 3*b* is pulled and is neatly torn off along the two cut lines 2. The cuts 31*b* on the pull tab 3*b* break one by one to the one connected to the pull tab 3*a*. Since the cuts 31*a* on the pull tab 3*a* break easier than the two tear lines 2, the cuts 31*a* on the pull tab 3*a* begin to break until the pull tab 3*a* is separated from the remaining portion of the carton. Next, the cut line 2 adjacent to the bottom of the carton begins to break, obtaining the same tearing effect as the example shown in FIG. 16.

In a case that the pull tab 3*a* is selected to tear open the carton, after the pull tab 3*a* has been separated from the remaining portion of the paperboard 1, the breaking occurs simultaneously along two sides of the pull tab 3*a*, such that the cut line 2 adjacent to the bottom of the carton breaks, providing higher tearing efficiency. In another case when the pull tab 3*b* is selected to tear open the carton, each edge of the carton is subject to the force in the peripheral direction of the carton during the tearing process, such that the tearing effect is better while providing the opening O with a smooth peripheral edge. Thus, the easy open carton of the third embodiment according to the present invention provides different options for the user to tear open the carton.

Figure 18:
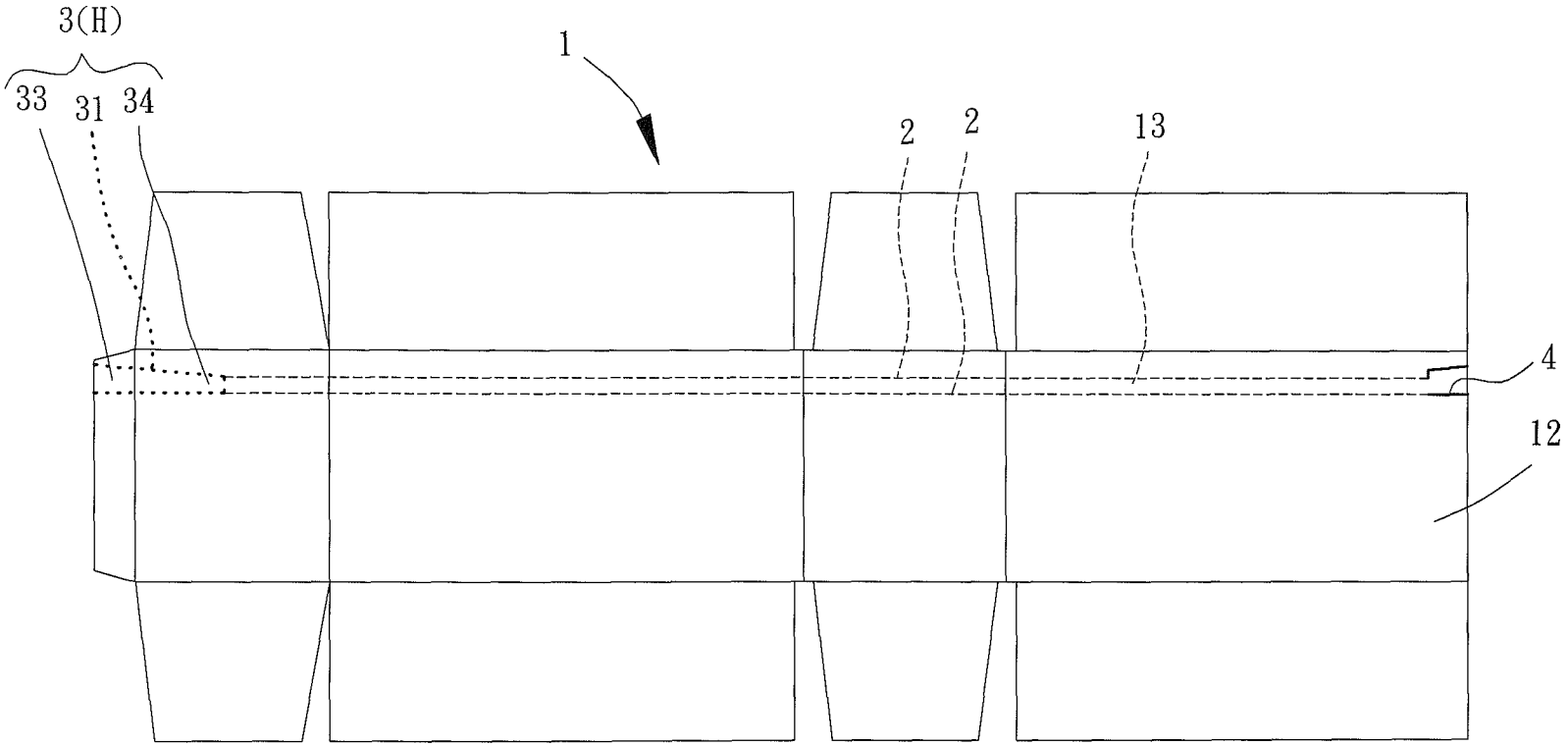
FIG. 18 is a flattened view of an easy open carton of a fourth embodiment according to the present invention.

FIG. 18 shows an easy open carton of a fourth embodiment according to the present invention. Compared to the second embodiment, the pull tab H of this embodiment further includes an extension 34 to increase the overall length of the pull tab H, such that the arm of force of the pull tab H can be increased during pulling, achieving a better force saving effect. As an example, the overall length of the pull tab H can be about 3-6 cm in this embodiment to increase the torque arm while providing the carton with a desired structural strength. However, the present invention is not limited to this example.

Furthermore, the pull tab H of this embodiment can also include a finger width portion 33, and the extension 34 is connected between the finger width portion 33 and the tear portion 13 of the paperboard 1. The extension 34 can have increasing or decreasing widths to smoothly connect the finger width portion 33 to the tear portion 13 of the paperboard 1, preventing stress concentration resulting from improper force application that might result in breakage of the pull tab H from the tear portion 13.

Figure 19:
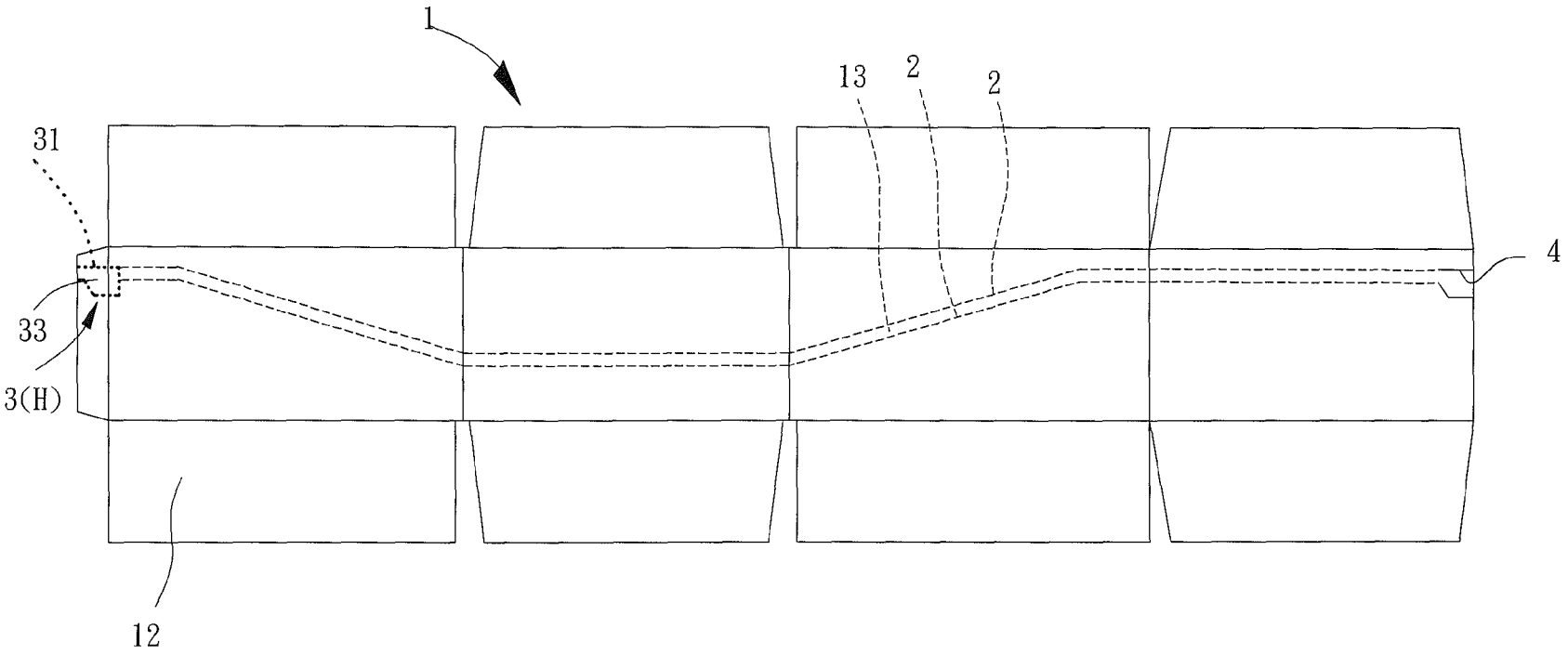
FIG. 19 is a flattened view of an easy open carton of a fifth embodiment according to the present invention.
Figure 20:
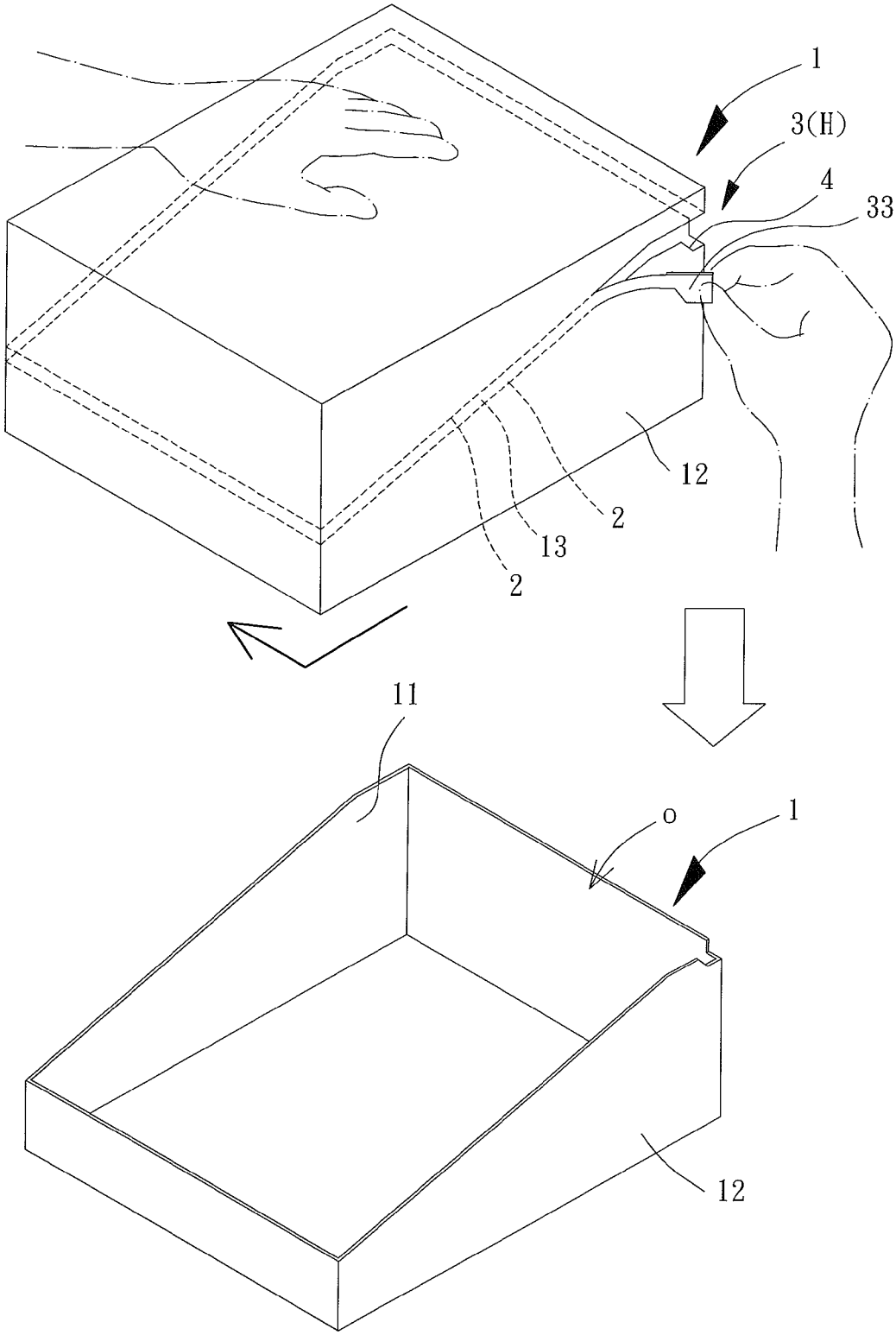
FIG. 20 is a perspective view illustrating tearing open of the easy open carton of the fifth embodiment according to the present invention.

FIGS. 19 and 20 show an easy open carton of a fifth embodiment according to the present invention. In this embodiment, each of the two cut lines 2 has a slant section, such that the opening O of the carton inclines upwards and rearwards (see FIG. 20) after the carton is torn open.

Figure 21:
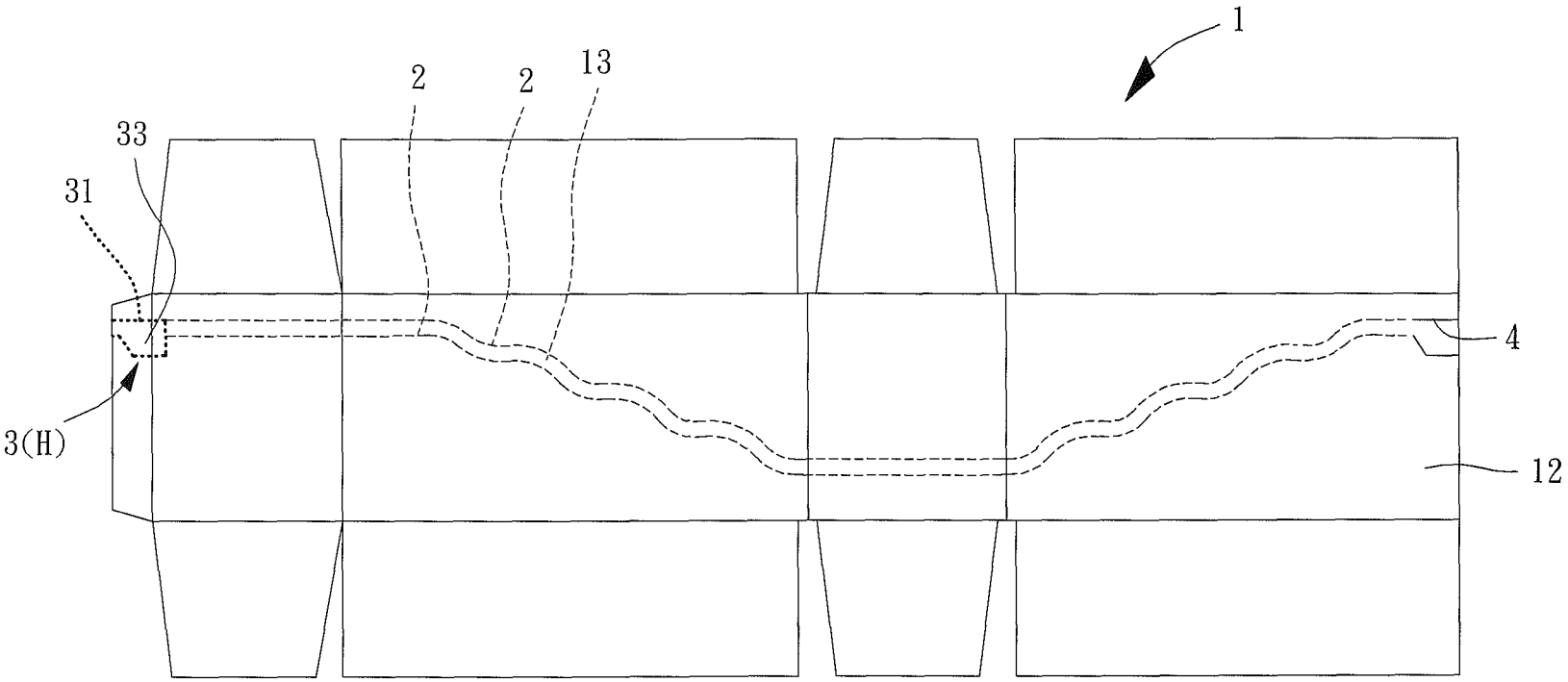
FIG. 21 is a flattened view of an easy open carton of an example having a cut line with a curved portion according to the present invention.

In another example shown in FIG. 21, each of the two cut lines 2 can include a curved section, such that the opening O of the carton not only inclines upwards and rearwards but presents two curved edges after the carton is torn open. Thus, the outline of the opened carton can be varied by changing the curvature of the cut lines 2.

Figure 22:
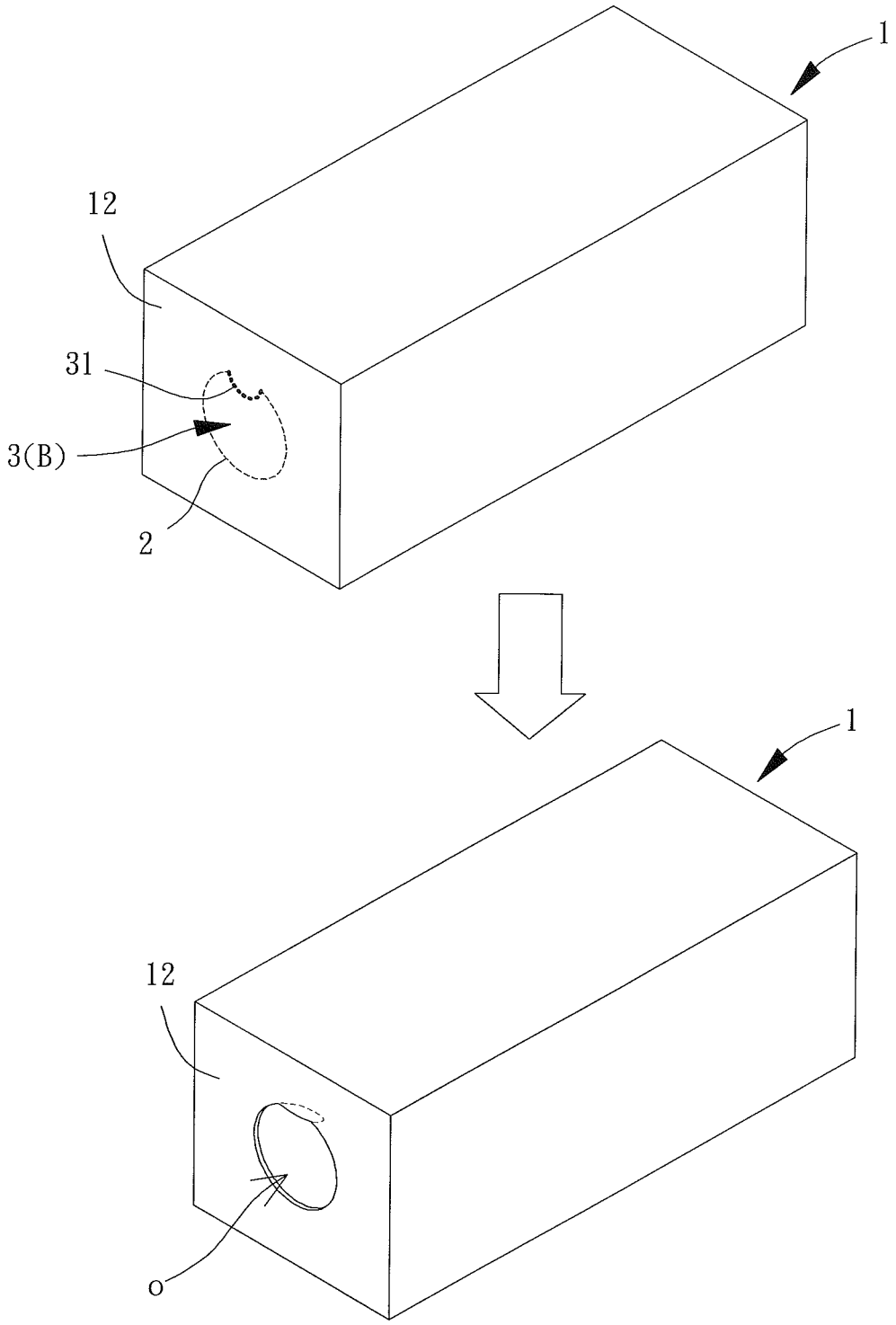
FIG. 22 is a perspective view illustrating use of an easy open carton of an example of a sixth embodiment according to the present invention.
Figure 23:
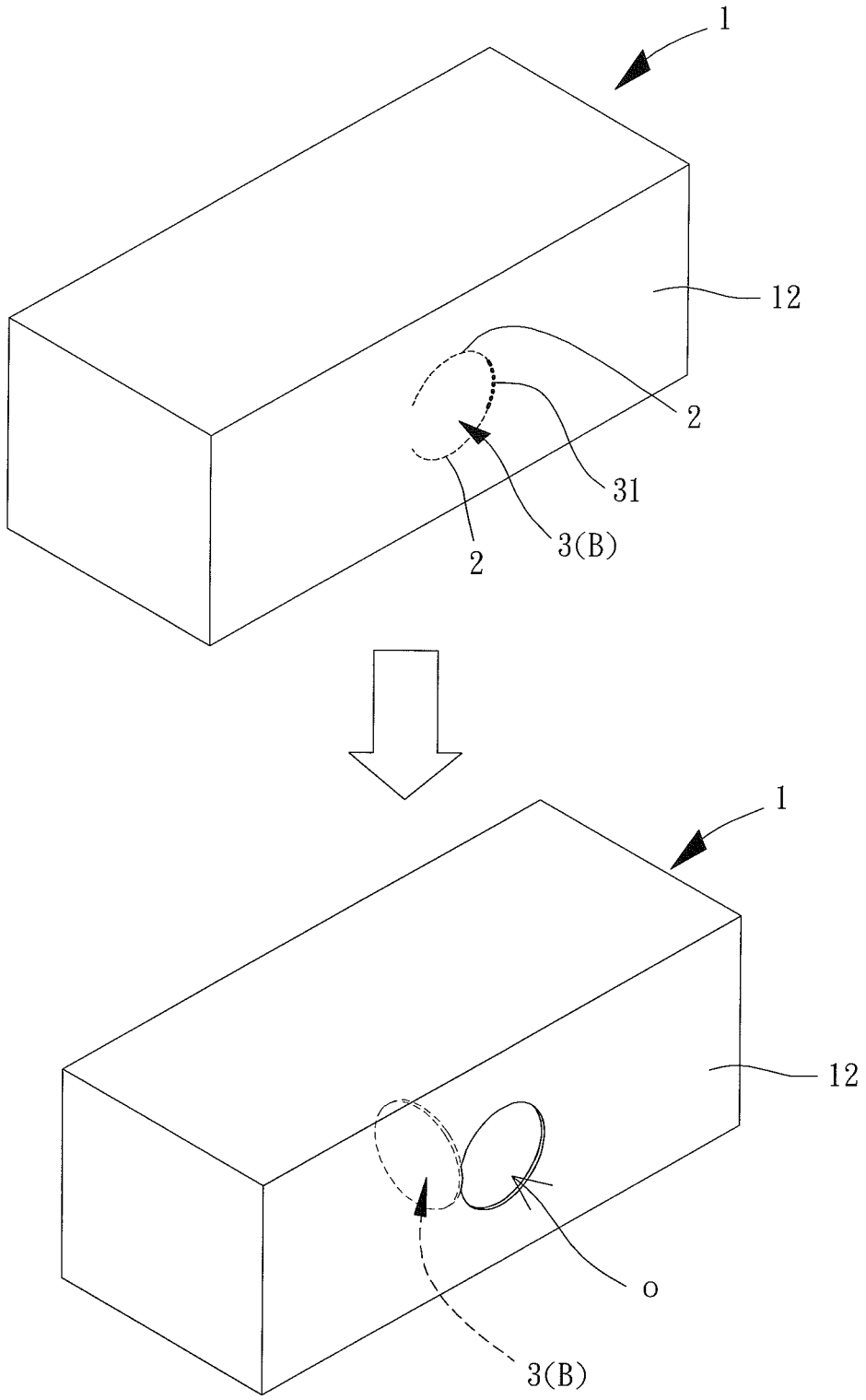
FIG. 23 is a perspective view illustrating use of an easy open carton of another example of the sixth embodiment according to the present invention.
Figure 24:
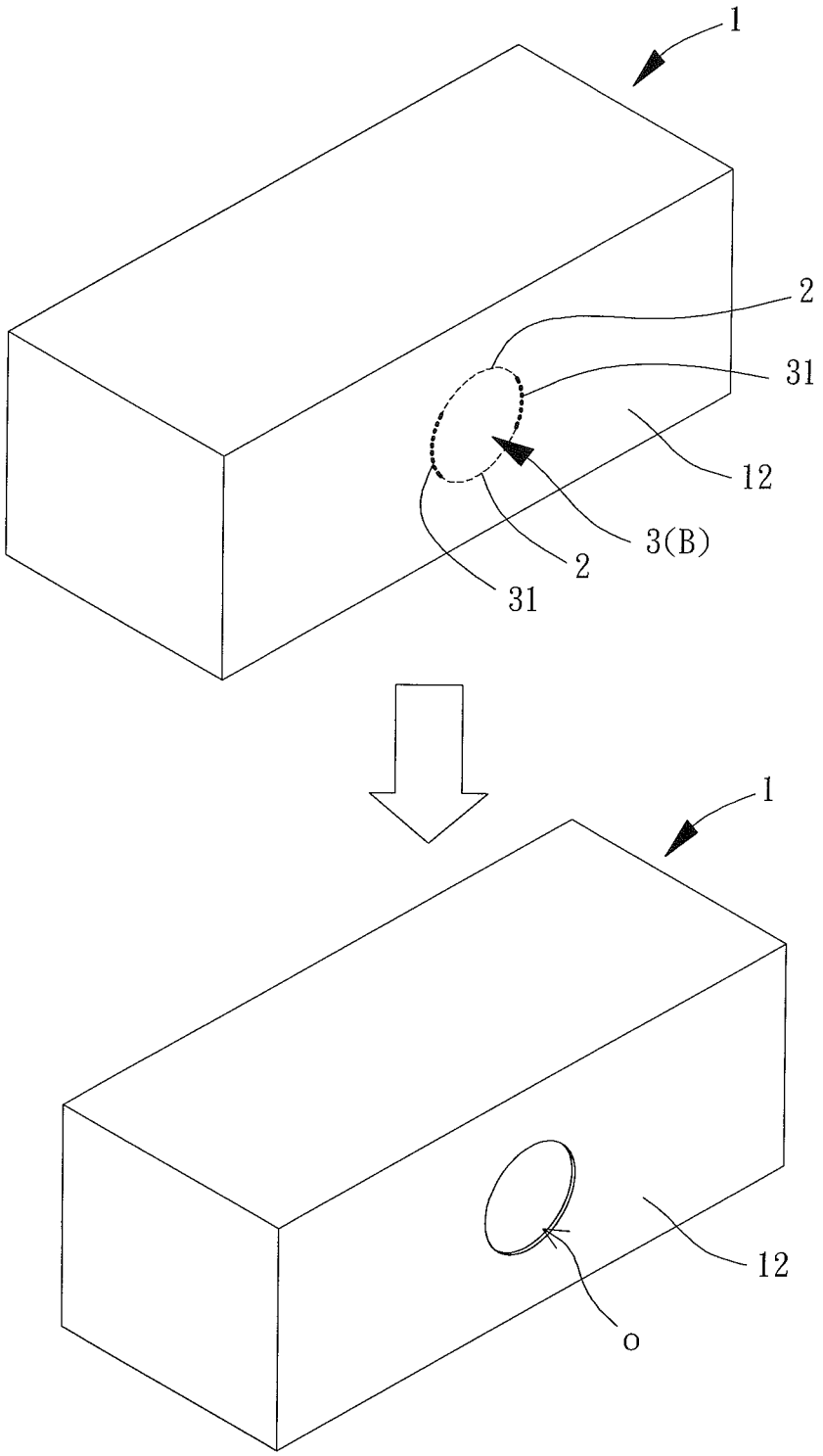
FIG. 24 is a perspective view illustrating use of an easy open carton of a further example of the sixth embodiment according to the present invention.

FIGS. 22-24 show an easy open carton of a sixth embodiment according to the present invention. In this embodiment, the cuts 31 of the force application portion 3 and the at least one cut line 2 together outline a shield piece B. After the force application portion 3 has been destructed by the user, an opening O having a shape substantially identical to the shape of the shield piece B is torn open. Compared to the previous embodiments, the opening O in this embodiment is smaller to avoid excessive exposure of the interior of the carton. Thus, this embodiment fulfils the need of a carton of a smaller opening in use.

In the example shown in FIG. 22, the shield piece B is outlined by the cuts 31 and a cut line 2. When it is desired to tear open the carton, the user pokes in the carton by the cuts 31 and pulls the shield piece B outwards to break the cut line 2, separating the shield piece B from the remaining portion of the paperboard 1 while tearing open an opening O having a shape substantially identical to the shape of the shield piece B to permit access to the objects in the carton.

In the example shown in FIG. 23, the shield piece B is outlined by the cuts 31 and the two cut lines 2. The cuts 31 are mounted between the two cut lines 2 and are connected to an end of each cut line 2. The other end of each cut line 2 is not processed. When it is desired to tear open the carton, the user pokes in the carton by the cuts 31 and pulls the shield piece B outwards or pushes the shield piece B inwards to break the cut lines 2. Although the shield piece B is still connected to the remaining portion of the paperboard 1, an opening O having a shape substantially identical to the shape of the shield piece B is torn open in the carton to permit access to the objects in the carton.

In the example shown in FIG. 24, the shield piece B is outlined by the cuts 31 and the two cut lines 2. Some of the cuts 31 are connected between first ends respectively of the two cut lines 2. The remaining cuts 31 are connected between second ends respectively of the two cut lines 2. When it is desired to tear open the carton, the user pokes in the carton by some of the cuts 31 and pulls the shield piece B outwards or pushes the shield piece B inwards to break the two cut lines 2 and the remaining cuts 31. Thus, the shield piece B can be separated from the remaining portion of the paperboard 1, and an opening O having a shape substantially identical to the shape of the shield piece B is torn open in the carton to permit access to the objects in the carton.

According to the above, the easy open carton according to the present invention, after being torn open, can have different shapes by adjusting the positions and outlines of the cut lines 2, which can be appreciated by a person having ordinary skill in the art. Furthermore, the shape of the carton can be adjusted according to needs. Thus, the patterns of the easy open carton according to the present invention is not limited to the above embodiments. Furthermore, in the case that the easy open carton according to the present invention includes two cut lines 2, the cut lines 2 do not have to be parallel to each other as shown. Namely, the cut lines 2 can be in a non-parallel relation.

In view of the foregoing, in the easy open carton according to the present invention, by providing at least one cut line 2 in the inner face 11 of the paperboard 1 not extending to the outer face 12 of the paperboard 1, the carton is easy to tear open without increasing the material costs while providing good structural strength, such that the carton is less likely to be damaged by an external force in an unexpected manner. Furthermore, the at least one cut line 2 can be formed by using a cutter to cut the inner face 11 of the paperboard 1, such that the at least one cut line 2 can be of any shape to constitute any desired tearing path, possessing excellent utility to meet various needs while providing easy operational convenience in disposing the tearing path.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. An easy open carton as comprising:

a paperboard including an inner face and an outer face, with the paperboard including a plurality of folding flaps permitting the paperboard to be folded to form a three dimensional carton, with the inner face of the paperboard including a tear portion;

two cut lines provided on the inner face of the paperboard, with the tear portion of the inner face of the paperboard formed between the two cut lines;

a force application portion including a plurality of cuts disposed intermittently or continuously, with each of the plurality of cuts extending from the inner face through the outer face of the paperboard, and with the force application portion connected to the two cut lines, with the plurality of cuts outlining a pull tab, with the pull tab connected to an end of the tear portion; and a start index disposed on one of the plurality of folding flaps and connected to another end of the tear portion, wherein when the paperboard is folded to form the three dimensional carton, the one of the plurality of folding flaps including the start index is connected to another of the plurality of folding flaps including the pull tab.

2. The easy open carton as claimed in claim 1, wherein the pull tab is connected to an end of each of the two cut lines.

3. The easy open carton as claimed in claim 2, wherein each of the two cut is extends along an annular top edge of the carton formed by the paperboard.

4. The easy open carton as claimed in claim 2, wherein the pull tab includes an insertion slot extending from the inner face through the outer face of the paperboard and connected to the plurality of cuts on the pull tab.

5. The easy open carton as claimed in claim 1, wherein the start index is a notch extending from the inner face through the outer face of the paperboard.

6. The easy open carton as claimed in claim 1, wherein the start index is an area outlined by a plurality of another cuts disposed intermittently or continuously, and each of the plurality of another cuts outlining the start index extends from the inner face through the outer face of the paperboard.

7. The easy open carton as claimed in claim 1, with the pull tab including a finger width portion and an extension connected between the finger width portion and the tear portion of the paperboard, and with the extension having increasing or decreasing widths to smoothly connect the finger width portion to the tear portion of the paperboard.

8. The easy open carton as claimed in claim 7, wherein the pull tab has an overall length of 3-6 cm.

9. The easy open carton as claimed in claim 1, wherein the plurality of cuts outlining the pull tab are adjacent to a bottom of the carton and are on a same line as one of the two cut lines adjacent to the bottom of the carton.

10. The easy open carton as claimed in claim 1, wherein the paperboard further includes a plurality of another cuts outlining another pull tab, and the other pull tab is connected between two ends of one of the two cut lines, with the one of the two cut lines being adjacent to a bottom of the carton.

11. The easy open carton as claimed in claim 1, wherein the pull tab includes a finger width portion having a width of 1-3 cm and a length of 1-3 cm.

12. The easy open carton as claimed in claim 1, wherein the plurality of cuts and the two cut lines together outline a shield piece.

13. The easy open carton as claimed in claim 1, with the paperboard being a corrugated paper including an inner paper layer and an outer paper layer directly or indirectly connected to the inner paper layer, with the inner paper layer including the inner face of the paperboard, with the outer paper layer including the outer face of the paperboard, and with the inner paper layer severed by the two cut lines.

14. The easy open carton as claimed in claim 1, wherein the paperboard is a paperboard having a single layer, and the depth of each of the two cut lines is smaller than or equal to a half of a depth of the paperboard.

* * * * *